US011383946B2

(12) United States Patent
Techlin

(10) Patent No.: US 11,383,946 B2
(45) **Date of Patent: *Jul. 12, 2022**

(54) SOLID ROLL PRODUCT FORMED FROM SURFACE REWINDER WITH BELT AND WINDING DRUM FORMING A WINDING NEST

(71) Applicant: Paper Converting Machine Company, Green Bay, WI (US)

(72) Inventor: Michael E. Techlin, De Pere, WI (US)

(73) Assignee: Paper Converting Machine Company, Green Bay, WI (US)

( * ) Notice: Subject to any disclaimer, the term of this patent is extended or adjusted under 35 U.S.C. 154(b) by 257 days.

This patent is subject to a terminal disclaimer.

(21) Appl. No.: 16/851,661

(22) Filed: Apr. 17, 2020

(65) Prior Publication Data

US 2020/0361734 A1 Nov. 19, 2020

Related U.S. Application Data

(60) Provisional application No. 62/846,779, filed on May 13, 2019.

(51) Int. Cl.
*B65H 19/26* (2006.01)
*B65H 19/22* (2006.01)

(52) U.S. Cl.
CPC ..... *B65H 19/2238* (2013.01); *B65H 19/26* (2013.01); *B65H 2301/4189* (2013.01); *B65H 2301/41812* (2013.01); *B65H 2408/23* (2013.01)

(58) Field of Classification Search
CPC ..... B65H 19/26; B65H 19/2269; B65H 19/2238; B65H 2301/41812; B65H 2404/261; B65H 2404/262; B65H 20/06
See application file for complete search history.

(56) References Cited

U.S. PATENT DOCUMENTS 1,437,398 A 12/1922 Cameron
2,090,130 A 8/1937 Kittel
(Continued)

FOREIGN PATENT DOCUMENTS

EP 2550218 B1 1/2016
EP 3148906 B1 8/2018
(Continued)

OTHER PUBLICATIONS

Aarinen, "Optimisation of Customer Roll Quality in Winding", International Pulp and Paper Technology, 2006, pp. 1-34.
(Continued)

*Primary Examiner* — Sang K Kim
(74) *Attorney, Agent, or Firm* — Thompson Coburn LLP

(57) ABSTRACT

A rewinding machine winds web material into a log. The machine has a winding drum that is rotatable about a center axis and about which the web material to be wound is directed. A continuous loop is spaced from the winding drum and with the winding drum defines a nip through which the web material is directed when winding the web material into the log. The continuous loop is configured to move in a direction generally opposite of a direction of the winding drum at the nip. The continuous loop is configured to change speed relative to a speed of the winding drum during winding the web material into the log about a lead edge of the web material. The continuous loop is positionable relative to the winding drum at the nip to accommodate winding the web material into the log about the lead edge of the web material and to sever the web material.

19 Claims, 14 Drawing Sheets

(56) References Cited

U.S. PATENT DOCUMENTS

| | | | |
|---|---|---|---|
| 2,385,692 | A | 9/1945 | Corbin |
| 2,749,133 | A | 6/1956 | Rich |
| 2,883,121 | A | 4/1959 | Barlament et al. |
| 3,097,808 | A | 7/1963 | Williams |
| 3,148,843 | A | 9/1964 | Turner et al. |
| 3,592,403 | A | 7/1971 | Schmitt et al. |
| 3,610,545 | A | 10/1971 | Reifenhauser et al. |
| 3,704,835 | A | 12/1972 | Harley |
| 3,791,602 | A | 2/1974 | Isakson |
| 3,841,578 | A | 10/1974 | Dorfel |
| 3,844,501 | A | 10/1974 | Spencer |
| 4,327,877 | A | 5/1982 | Perini |
| 4,487,377 | A | 12/1984 | Perini |
| 4,583,698 | A | 4/1986 | Nistri et al. |
| 4,723,724 | A | 2/1988 | Bradley |
| 4,842,209 | A | 6/1989 | Saukkonen |
| 4,856,725 | A | 8/1989 | Bradley |
| 4,962,897 | A | 10/1990 | Bradley |
| 5,137,225 | A | 8/1992 | Biagiotti |
| 5,150,848 | A | 9/1992 | Consani |
| 5,150,850 | A | 9/1992 | Adams |
| 5,368,252 | A | 11/1994 | Biagiotti |
| 5,370,335 | A | 12/1994 | Vigneau |
| 5,372,331 | A | 12/1994 | Miller et al. |
| 5,505,405 | A | 4/1996 | Vigneau |
| 5,538,199 | A | 7/1996 | Biagiotti |
| 5,639,045 | A | 6/1997 | Dorfel |
| 5,639,046 | A | 6/1997 | Biagiotti |
| 5,690,296 | A | 11/1997 | Biagiotti |
| 5,725,176 | A | 3/1998 | Vigneau |
| 5,769,352 | A | 6/1998 | Biagiotti |
| 5,839,680 | A | 11/1998 | Biagiotti |
| 5,901,918 | A | 5/1999 | Klerelid et al. |
| 5,934,604 | A | 8/1999 | Klimek |
| 5,954,291 | A | 9/1999 | Meinecke et al. |
| 5,979,818 | A | 11/1999 | Perini et al. |
| 6,056,229 | A | 5/2000 | Blume et al. |
| 6,082,659 | A | 7/2000 | Sankaran et al. |
| 6,109,559 | A | 8/2000 | Dorfel et al. |
| 6,199,789 | B1 | 3/2001 | Marco |
| 6,283,402 | B1 | 9/2001 | Fordham |
| 6,422,501 | B1 | 7/2002 | Hertel et al. |
| 6,595,458 | B1 | 7/2003 | Biagiotti |
| 6,729,572 | B2 | 5/2004 | Baggot et al. |
| 6,866,220 | B2 | 3/2005 | Sosalla et al. |
| 6,877,689 | B2 | 4/2005 | Butterworth |
| 6,945,491 | B2 | 9/2005 | Gambini |
| 7,000,864 | B2 | 2/2006 | McNeil et al. |
| 7,104,494 | B2 | 9/2006 | Casella et al. |
| 7,175,126 | B2 | 2/2007 | Perini |
| 7,175,127 | B2 | 2/2007 | Butterworth et al. |
| 7,222,813 | B2 | 5/2007 | Tung-I |
| 7,293,736 | B2 | 11/2007 | Recami et al. |
| 7,344,104 | B2 | 3/2008 | Hada et al. |
| 7,392,961 | B2 | 7/2008 | McNeil et al. |
| 7,455,260 | B2 | 11/2008 | McNeil et al. |
| 7,614,328 | B2 | 11/2009 | Perini et al. |
| 7,641,142 | B2 | 1/2010 | Tsai |
| 7,775,476 | B2 | 8/2010 | Recami et al. |
| 7,896,284 | B2 | 3/2011 | Morelli et al. |
| 7,909,282 | B2 | 3/2011 | Wojcik et al. |
| 7,942,363 | B2 | 5/2011 | Gelli et al. |
| 8,162,251 | B2 | 4/2012 | Vaughn et al. |
| 8,181,897 | B2 | 5/2012 | Tsai |
| 9,284,147 | B2 | 3/2016 | Techlin |
| 9,352,920 | B2 | 5/2016 | Morelli et al. |
| 9,701,505 | B2 | 7/2017 | Morelli et al. |
| 9,896,293 | B2 | 2/2018 | Haapanen et al. |
| 9,919,888 | B2 | 3/2018 | Techlin |
| 9,975,720 | B2 | 5/2018 | Techlin |
| 9,988,228 | B2 * | 6/2018 | Giannini ..... B65H 19/2238 |
| 11,046,540 | B2 * | 6/2021 | Techlin ..... B65H 18/26 |
| 11,247,863 | B2 * | 2/2022 | Techlin ..... B65H 19/2269 |
| 2004/0241094 | A1 | 12/2004 | Chung et al. |
| 2005/0279875 | A1 | 12/2005 | Biagiotti et al. |
| 2007/0176039 | A1 | 8/2007 | Gelli et al. |
| 2009/0302146 | A1 | 12/2009 | Morelli et al. |
| 2013/0026280 | A1 | 1/2013 | Li et al. |
| 2015/0307315 | A1 | 10/2015 | Techlin et al. |
| 2017/0210584 | A1 | 7/2017 | Morelli et al. |
| 2017/0233207 | A1 | 8/2017 | Dettori et al. |
| 2018/0179007 | A1 | 6/2018 | Seymour |

FOREIGN PATENT DOCUMENTS

| | | | |
|---|---|---|---|
| IT | 1230585 | B | 10/1991 |
| IT | 1230935 | B | 11/1991 |
| WO | 2015/181339 | A1 | 12/2015 |
| WO | 2019108480 | A1 | 6/2019 |

OTHER PUBLICATIONS

Good et al., "Winding: Machines, Mechanics and Measurements", 2008, pp. 4-9 and pp. 184-188, Tappi Press.

International Search Report and Written Opinion for PCT/US2018/062462 dated Nov. 26, 2018.

International Search Report and Written Opinion for PCT/US2019/033071 dated Jul. 19, 2019.

Roisum, "The Mechanics of Winding", 1994, pp. 1-15, Tappi Press.

* cited by examiner

SOLID ROLL PRODUCT FORMED FROM SURFACE REWINDER WITH BELT AND WINDING DRUM FORMING A WINDING NEST

RELATED APPLICATION DATA

This application claims the benefit of U.S. provisional app. Ser. No. 62/846,779, filed May 13, 2019, which is incorporated herein by reference.

INTRODUCTION

This disclosure relates to rewinding machines that wind a web material to form logs of wound web material, particularly rewinding machines that wind web material into solid logs by winding the web material around itself, without a central cardboard core, tube, mandrel, or shaft. Specifically, the disclosure is directed to an improved apparatus and method for severing the web, initiating winding of the web, and for controlling the logs during the introduction and winding phases. In particular, at least one belt is used in conjunction with a winding drum, which feeds the web, to form a winding nest. The web material may be fed between the drum and the belt. The speed of the belt relative to the web and winding drum, and position of the belt relative to the web and winding drum, may be controlled to cause severing of the web, which produces a leading edge in the web, and initiation of winding of the web into a log by rolling the leading end of the web up on itself and around itself, to form a rotating nucleus which is the beginning of the next log. The belt may be brought in close proximity to the winding drum and cooperate with the winding drum to sever the web material and initiate winding of the web material. The position and surface speed of the belt, relative to the winding drum, are also used to control the logs during the introduction, winding, and discharge phases.

BACKGROUND AND SUMMARY

A rewinder is used to convert large parent rolls of web into smaller sized rolls of bathroom tissue, kitchen towel, hardwound towel, industrial products, nonwovens products, and the like. A rewinder line consists of one or more unwind stations, modules for finishing—such as embossing, printing, perforating—and a rewind station at the end for winding. Typically the rewind station produces logs having a diameter of between 90 mm and 180 mm for bath tissue and kitchen towel and between 150 mm to 350 mm diameter for hardwound towel and industrial products. The width of the logs is usually 1.5 m to 5.4 m, depending on the parent roll width. Typically the logs are subsequently cut transversely to obtain small rolls having a width of between 90 mm and 115 mm for bath tissue and between 200 mm to 300 mm for kitchen towel and hardwound towel. In some cases the web from the parent roll is slit into ribbons and wound with the finished roll width at the rewind station, without the need for subsequent transverse cutting.

Typically the finished rolls have a through hole, or passage, at the central part of the roll, parallel to the axis of the roll. This passage may be formed by a tubular core, or the roll may be coreless. The central passage is useful for mounting the finished roll on a shaft or spindle for dispensing. However, some finished rolls have no through hole, or central passage, and instead are wound solid. The solid rolls do not have a separate core, but the center "core" is in essence a solid nucleus of web material windings. Depending on the methods and the conditions at the start of the winding, the nucleus may be higher or lower density than the windings of web around it. Nonetheless, the roll may be regarded as solid. A benefit of solid rolls is that more web material may be fit into the same diameter roll, due to the lack of a central passage, or void.

Two types of rewinding systems are commonly used for producing wound logs: center winders and surface winders. The defining characteristic of center winders is that the web is wound on a core that is supported and rotationally driven by a mandrel within the core, or in the alternative, the web may be wound directly on the mandrel, as in the case of coreless products. Because center winders require through holes in the finished logs for the winding mandrels, solid logs and rolls are produced on surface winders. The defining characteristic of surface winders is that the web is wound into a log that is supported and rotationally driven by machine elements at the log periphery. Thus, surface winding does not require through holes in the finished logs, and may be adapted to produce solid logs.

In co-owned and co-pending PCT application serial no. PCT/US2018/062462, and U.S. application Ser. No. 16/201,034, the disclosures of which are incorporated by reference herein, a surface rewinder is disclosed for winding the web material around central cores to form logs of wound web material, and for controlling the logs during the introduction, winding, and discharge phases. At least one belt is used in conjunction with a winding drum, which feeds the web, to form a winding nest. Between the drum and belt is a space through which the winding cores are inserted and through which the web material is fed. The belt is a continuous flexible member arranged as an endless loop, operably mounted so it can be moved with a velocity tangent to its surface. The belt is made to move with surface velocity in a direction generally opposite that of the inserted core and feeding web. This surface velocity of the belt, acting with the generally opposite surface velocity of the winding drum, causes the log to turn in rotation to wind the web material. In the co-owned and co-pending applications, it is disclosed that a stationary rolling surface is provided upstream from the belt, on the same side of the space between the winding drum and the belt as the belt. The inserted core is driven in rotation by the winding drum along the stationary rolling surface and then into a space between the winding drum and the belt.

In the present disclosure, it is an object to provide a rewinding system capable of being easily changed over between winding web material on cores or mandrels and winding web material into solid logs without a core or mandrel. It is also an object to provide a rewinding system that is capable of winding solid logs.

Thus, in one aspect, the rewinding system as disclosed in the co-owned and co-pending applications may be modified and adjusted to allow the surface of the belt to be brought into close proximity to the winding drum and cooperate with the winding drum to sever the web material and initiate winding of the web material around a lead edge (e.g., the just severed edge) of the web material to form a solid roll. The position and surface speed of the belt relative to the winding drum may be further used to control the progression of the winding log during its introduction into the winding nest, and thereafter, the subsequent winding and discharge phases of the wind cycle. It is advantageous that a single device, the belt, may be used for severing the web at the start of a product cycle, initiating winding of the web into a rotating log, controlling its introduction into the winding nest, completing the winding of the log, and controlling its discharge.

As will be described in more detail below, at least one belt is used in conjunction with a winding drum to form a winding nest. The web material is fed between the drum and belt. The belt is a continuous flexible member arranged as an endless loop, operatively mounted relative to the winding nest, so the belt can be moved with a velocity tangent to its surface. The belt may be adjusted to be near the winding drum so as to cooperate with the winding drum to sever the web material and initiate winding of a successive roll about the lead edge of the web material, for instance, the edge just severed. For instance, as the time for the severing of the web material approaches, the belt may be moved from its log winding position to a position close to the winding drum. The surface speed of the belt may be reduced, causing the winding log to separate from contact with the winding drum thereby initiating discharge of the winding log. Then, the surface of the belt may be moved toward the winding drum, and depending upon the application, against the winding drum, into contact with the web material between the winding drum and the belt. The belt may be made to move with surface velocity in a direction generally opposite that of the feeding web. The surface velocity of the belt acting with the generally opposite surface velocity of the winding drum serves to sever the web. It is preferable that the web have at least one line of perforations, where it is intended to be severed, and that the moment and duration of contact of the belt with the web material against the winding drum be synchronized with the line or lines of perforations in the web material so that a line of perforations immediately downstream of the point of contact of the belt with the web material is cleanly severed.

The pressure of the belt and its opposite direction of travel may induce the leading end of the web material to roll over itself, and around itself, and thereby form a rotating nucleus of the web material about which the remainder of the roll is wound. The position and surface speed of the belt are controlled to cause the forming log to roll forward as it rotates, so it advances through the space between the winding drum and the belt and progresses into the winding nest as it rotates and increases in diameter. As mentioned above, the belt is made to move with surface velocity in a direction generally opposite that of the feeding web. The surface velocity of the belt, acting with the generally opposite surface velocity of the winding drum, causes the log to turn in rotation to wind the web material about itself.

In another aspect of the disclosure, the surface velocity of the belt is varied cyclically relative to the velocity of the winding drum to control the advancement of a log through the space between the winding drum and the belt into the winding nest.

In another aspect of the disclosure, the surface velocity of the belt is varied cyclically relative to the velocity of the winding drum to control the winding of a log in the winding nest.

In another aspect of the disclosure, the surface velocity of the belt is varied cyclically relative to the velocity of the winding drum to control the discharge of a log from the winding nest.

In another aspect of the disclosure, the surface velocity of the belt is varied cyclically relative to the velocity of the winding drum and the distance between the belt and the winding drum is varied cyclically to control the advancement of a log through the space between the winding drum and the belt into the winding nest.

In another aspect of the disclosure, the surface velocity of the belt is varied cyclically relative to the velocity of the winding drum and the distance between the belt and the winding drum is varied cyclically to control the winding of a log in the winding nest.

In another aspect of the disclosure, the surface velocity of the belt is varied cyclically relative to the velocity of the winding drum and the distance between the belt and the winding drum is varied cyclically to control the discharge of a log from the winding nest.

In another aspect of the disclosure, the winding nest is provided with a rider roll, which is rotatably mounted, and is movable relative to the winding drum and the belt to allow an increase in diameter of each log in the winding nest.

In another aspect of the disclosure, the belt is substantially under the winding log in the winding nest.

In another aspect of the disclosure, the winding log remains substantially in contact with the winding drum during a preponderance of the winding cycle, until it is nearly complete, when it separates from the winding drum at the start of log discharge from the winding nest.

In another aspect of the disclosure, the winding log remains substantially in contact with the belt during a preponderance of the winding cycle, from when it first contacts the belt, until it moves away from the belt during log discharge from the winding nest.

In another aspect of the disclosure, the winding log remains substantially in contact with a rider roll during a preponderance of the winding, from when it first contacts the rider roll, until it is nearly complete, when it separates from the rider roll during log discharge from the winding nest.

DETAILED DESCRIPTION

Figure 1:
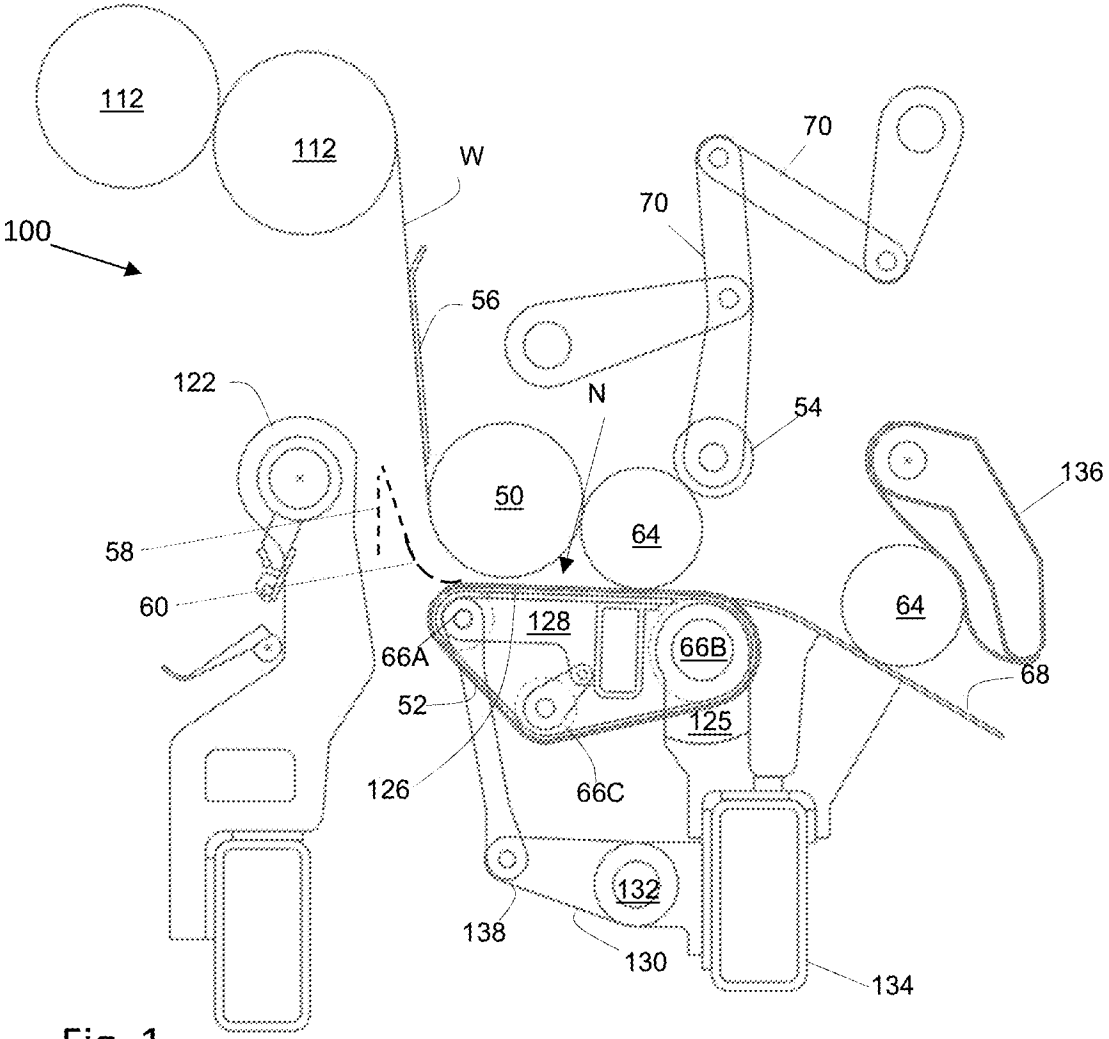
FIG. 1 shows an exemplary embodiment of a winding nest configuration comprising a winding drum, a belt, and a rider roll where a pinch plate and inserter associated with severing a web to wind the web material around a core or mandrel are shown, but not used, and transfer fingers and a transfer plate associated with the process of initiating winding of a web material around a core or mandrel have been removed.

FIG. 1 shows a schematic side view of an embodiment of a rewind system 100 which may use a winding nest configuration as described previously in this specification and include other components forming a path for the web material W to be wound. Although not shown in the drawings, the system may include a web spreading roller, upper web feeding and guiding rollers, and downstream therefrom, the rewind system 100 may be provided with a perforating unit. The perforating unit may be configured to produce perforation lines in the web material W, which make the web weaker at localized points where it may be separated by the rewind system for web transfer or may be separated by the end user into individual sections or sheets, or both. Perforating roll members may be provided with stationary cutting knives or blades for the perforating function. Perforating roll member may be provided with one or more rotating knives or blades for the perforating function. Non-contact perforation devices known by those skilled in the art may also be used. Downstream of the perforating unit, the rewind system may be provided with lower web feeding and guiding rollers 112, also known as lower draw rolls.

FIGS. 1-13 show an exemplary embodiment of a winding nest N configuration comprising a winding drum 50, a belt 52, and a rider roll 54. The exemplary embodiment of FIGS. 1-13 may be used for products having a log diameter range of between 90 mm and 225 mm. The winding drum may have a diameter of 165 mm. The rider roll may have a diameter of 85 mm. The web W approaches the winding drum 50 from above and wraps around the drum to the web winding region. Thus, the winding drum 50 also directs and delivers the web to the log in the winding nest N. The web W passes into the winding nest configuration N between the winding drum 50 and the belt 52. The belt 52 is disposed around pulleys 66, at least one of which is driven, to cause the surface of the belt to move in the opposite direction as the surface of the winding drum 50 opposite of the belt. The motion of the belt 52 in this direction causes the log 64 to rotate and wind the feeding web W around the log and thus increase its diameter. The web may be fed to the winding drum 50 with a flexible web feeding or conveying device.

Shown approximately vertical in the drawings is a pinch plate 56, which is associated with severing a web when winding a web material around a core or mandrel. Shown to the left of the winding drum is an inserter 122, which is associated with inserting a core or mandrel and severing a web when winding a web material around a core or mandrel. When used, the pinch plate and inserter may perform the web cut-off similar to the system shown in U.S. Pat. No. 6,056,229, the disclosure of which is incorporated by reference. When arranged or configured to wind solid logs the inserter 122 and pinch plate 56 may remain in place, but are not used. FIG. 1 shows the transfer fingers 58 and the rolling surface 60 in phantom, both which are associated with the process of initiating winding of a web material around a core or mandrel, if web transfer is performed similar to the system shown in U.S. Pat. No. 6,056,229. The rolling surface may be retracted or removed, as is indicated in the drawings, to allow space for the belt to be moved into close proximity to the winding drum. The rolling surface may conceivably be left in place, if it is comprised of discrete fingers operating with multiple belts, and these fingers interdigitate with the parallel belts. The transfer fingers may remain in place, but are not used. Or they may be retracted or removed, for instance if integral with, or mounted to, the rolling surface or the rolling surface support, and the rolling surface is removed. Other web severing and transferring mechanisms for winding web on cores or mandrels may be provided, such as systems disclosed in U.S. Pat. Nos. 5,979,818, 7,614,328, 5,150,848, 6,422,501, 6,945,491, 7,175,126, 7,175,127, 8,181,897, 9,586,779, EP 3148906, or other systems for severing the web on the winding drum with a movable blade or pinching pad and/or transferring the web vis-à-vis a longitudinal line or circumferential rings of glue or moisture, electro-static means, or a web tucking system, which would then be disabled, removed, retracted, or not used when the machine is arranged or configured to produce solid logs with a belt and winding drum. When configured to produce solid logs with a belt and winding drum the web may instead be severed in the manner described below.

While the drawings show the web W approaching the winding drum 50 generally vertically, the approach angle of the web to the winding drum 50 may be rightward or leftward of the generally vertical shown in the drawings. In the application described herein, the fingers 58 are not used and rendered in operable, or removed. Also, for the application described herein, the rolling surface 60 is not used and rendered inoperable, or removed. Although the description that follows describes a single belt, the description is not intended to be limiting in any sense and several parallel belts may be provided. Additionally, the term belt is not intended to be limiting, and may be viewed as a continuous flexible member arranged in an endless loop capable of being imparted with a velocity tangent to its surface, regardless of whatever material, materials, or construction techniques afford the function and properties described herein. Further, the term "web" is intended to cover material in wide webs, narrow webs, single webs, and a plurality of webs (ribbons), whether slit or cut after unwinding, or derived from multiple unwinds.

Figure 2:
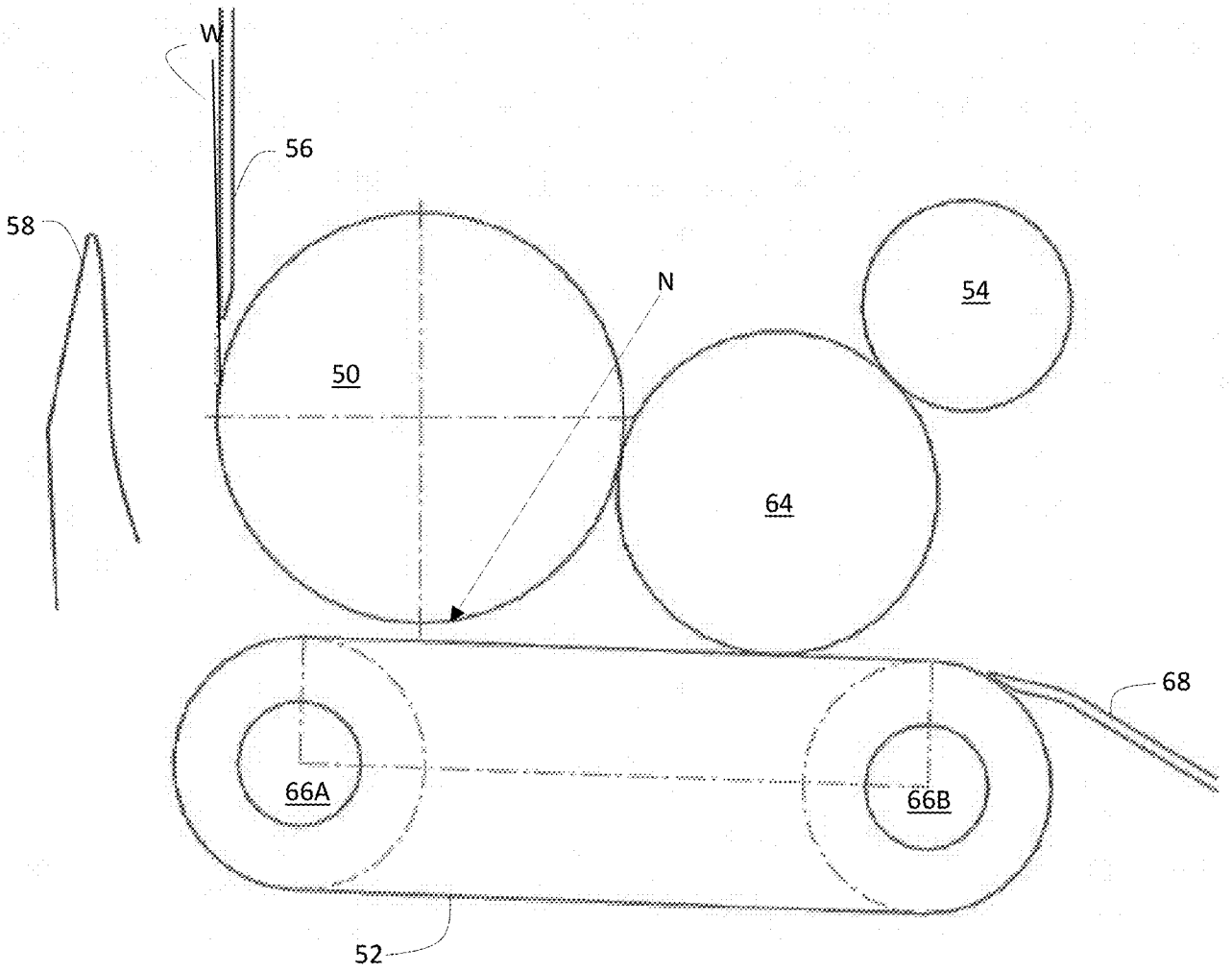
FIG. 2 illustrates the winding nest of FIG. 1, and winding of a 130 mm diameter solid log, with the belt at an angle of 2° inclination.
Figure 3:
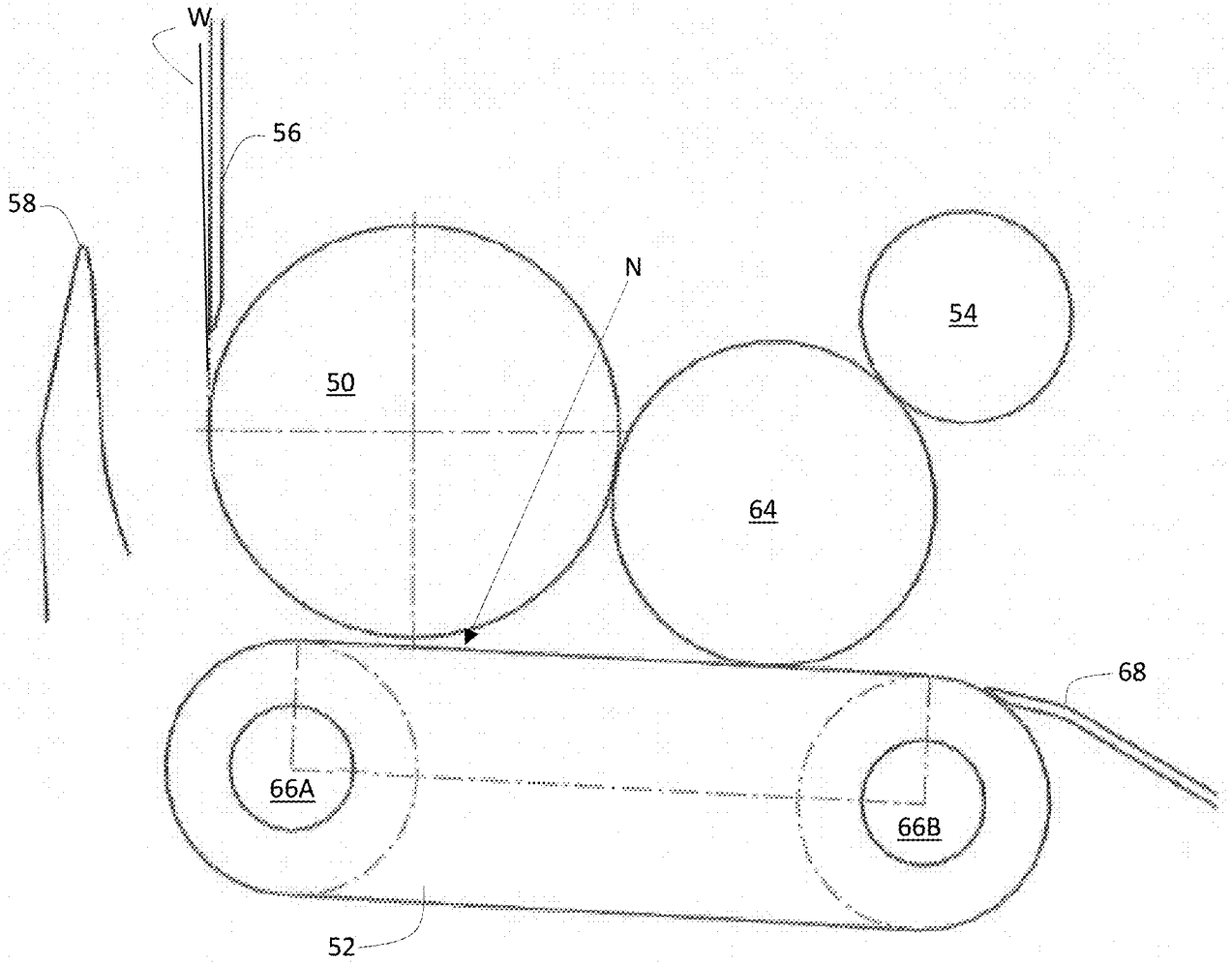
FIG. 3 illustrates the winding nest of FIG. 1, and winding of a 130 mm diameter solid log, with the belt moved up to an angle of 3° inclination.
Figure 4:
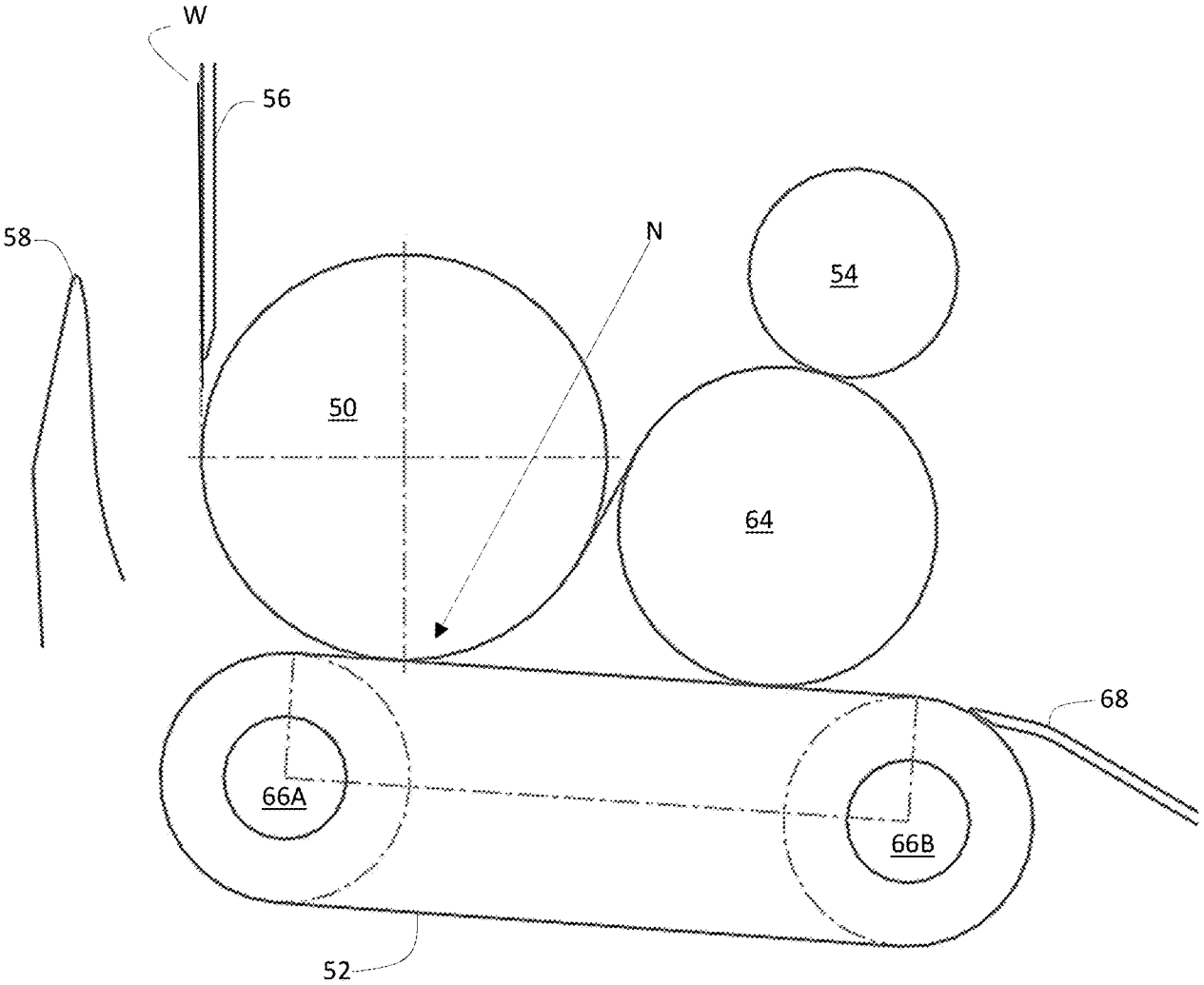
FIG. 4 illustrates the winding nest of FIG. 1, and starting to discharge a 130 mm diameter solid log, with the belt moved up to an angle of 4° inclination to cause contact with the web at the underside of the winding drum.
Figure 5:
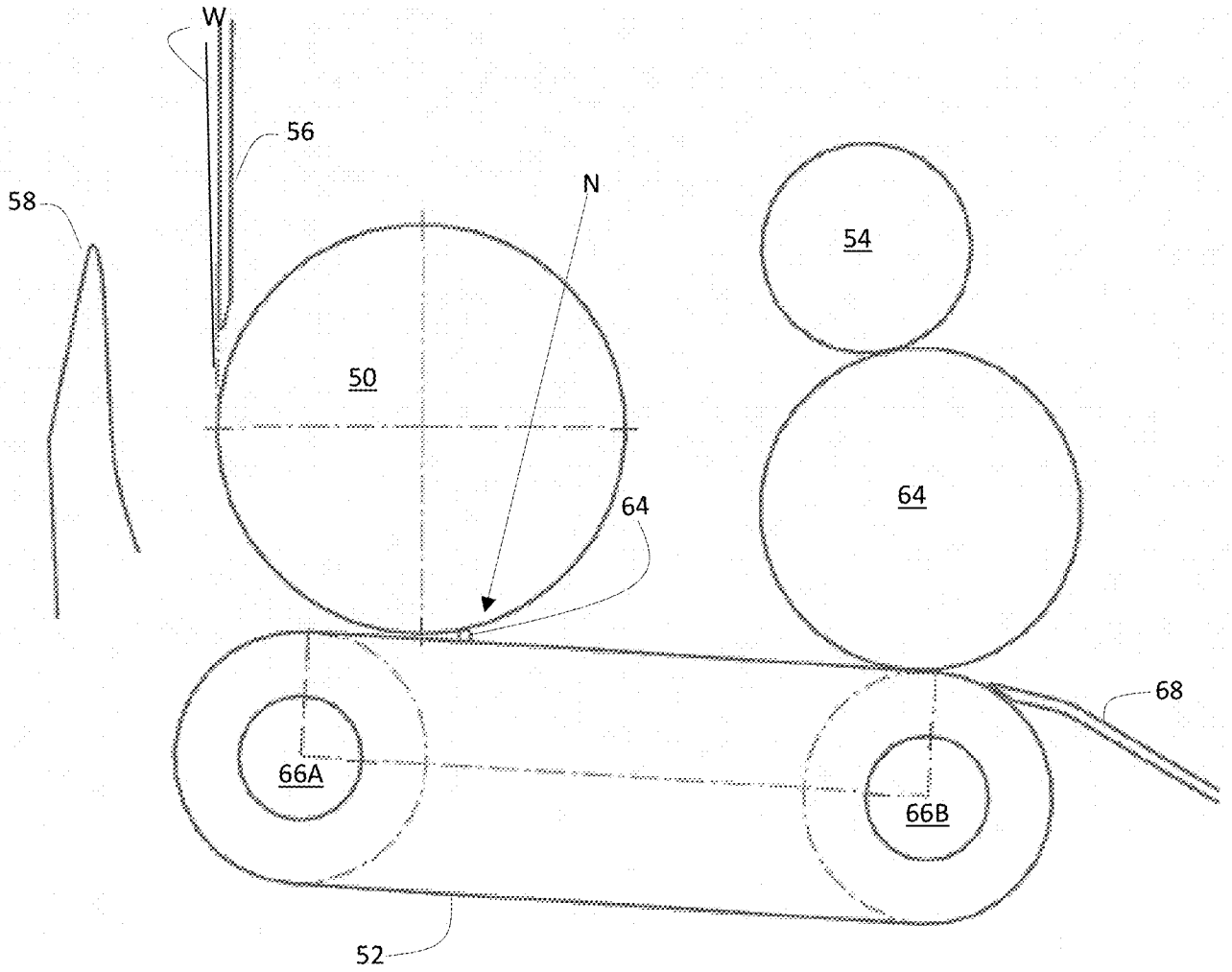
FIG. 5 illustrates the winding nest of FIG. 1, and discharging a 130 mm diameter solid log, with the belt moved down to an angle of 3.5° inclination and a nucleus of wound web material emerging from a nip between the winding drum and the belt.
Figure 6:
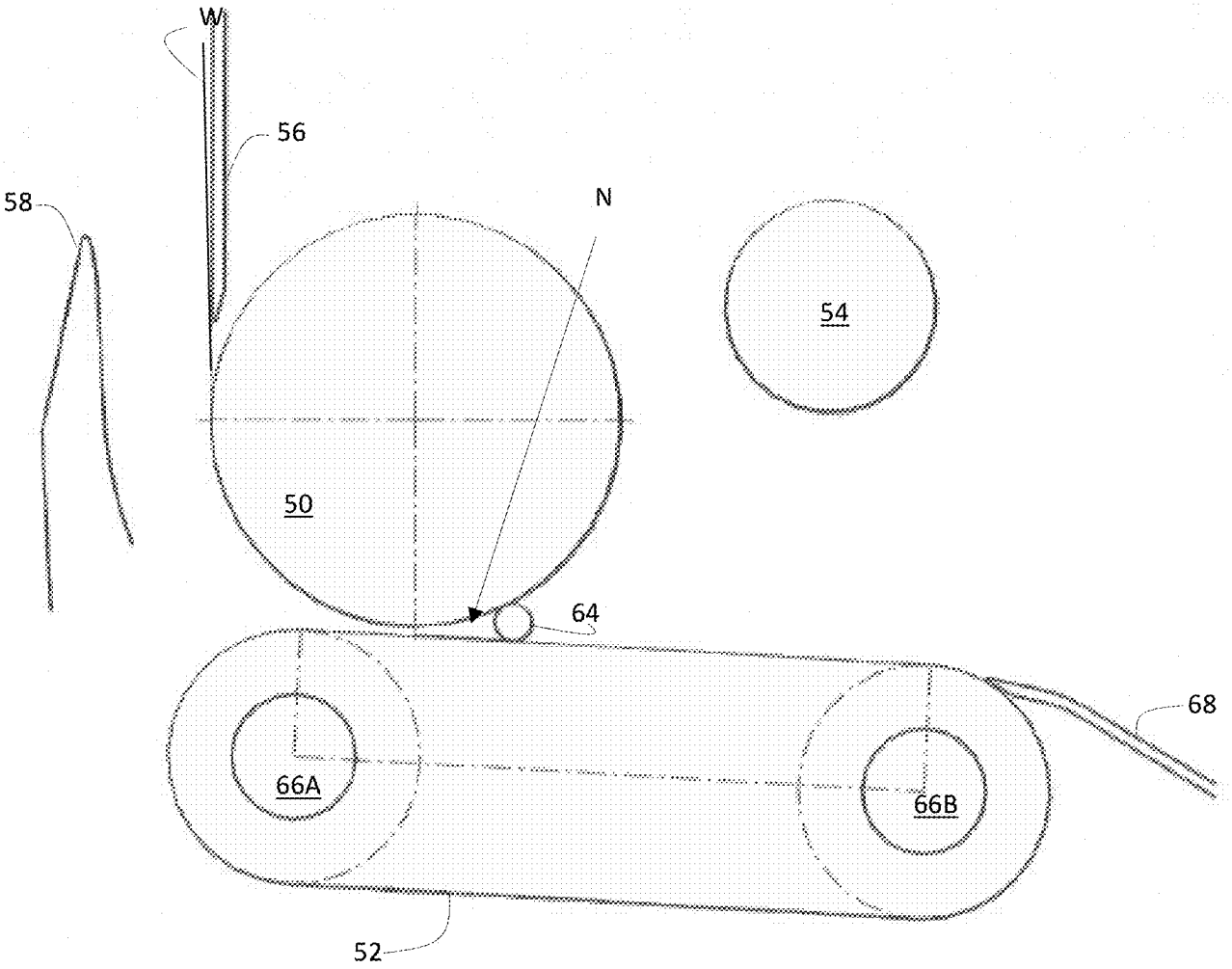
FIG. 6 illustrates the winding nest of FIG. 1, and the nucleus of the wound web material emerging from the nip between the winding drum and the belt, and the belt moved down to an angle of 3° inclination.
Figure 7:
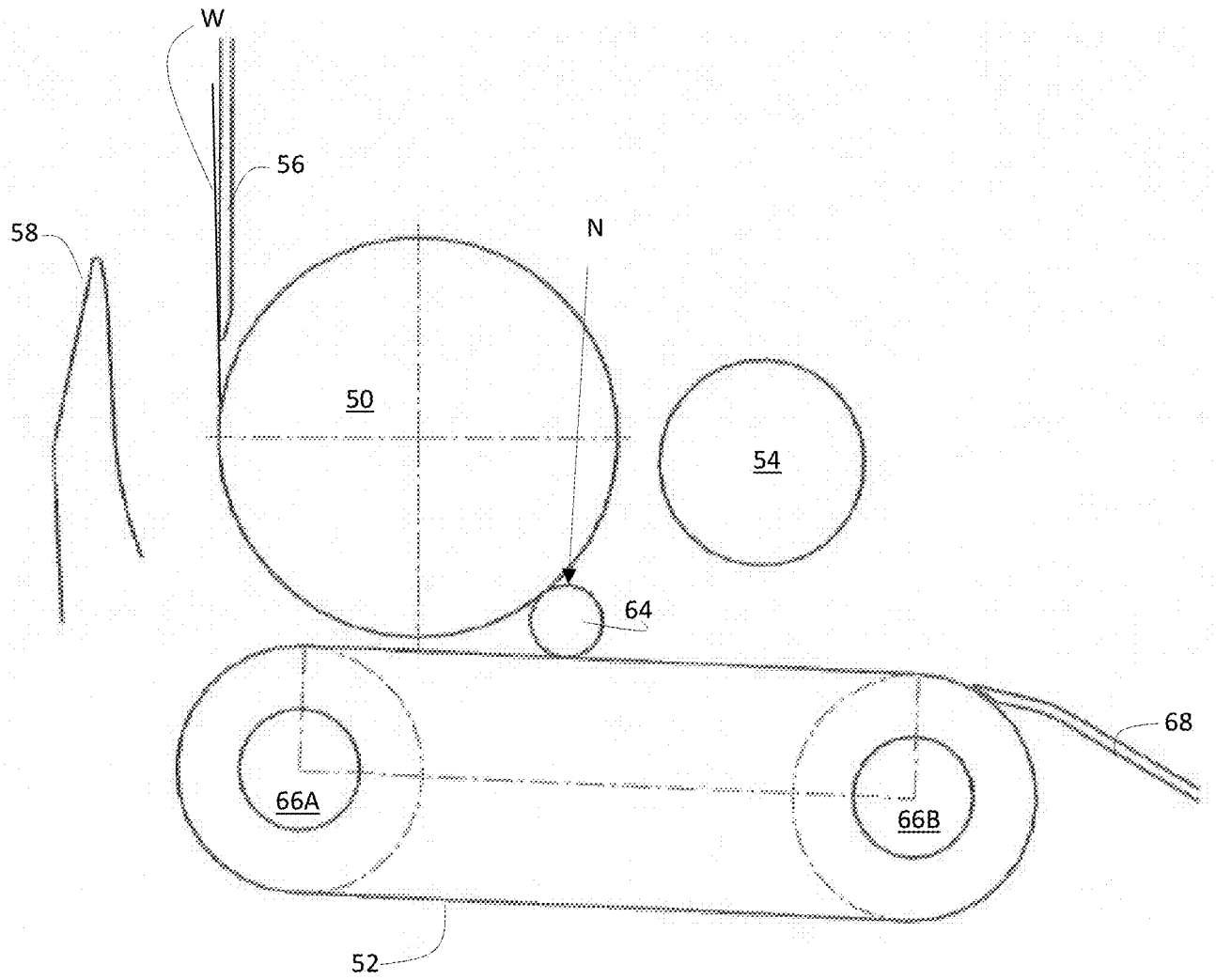
FIG. 7 illustrates the winding nest of FIG. 1, and a small diameter solid log emerging from the nip between the winding drum and the belt, and the belt moved down to an angle of 2.5° inclination.
Figure 8:
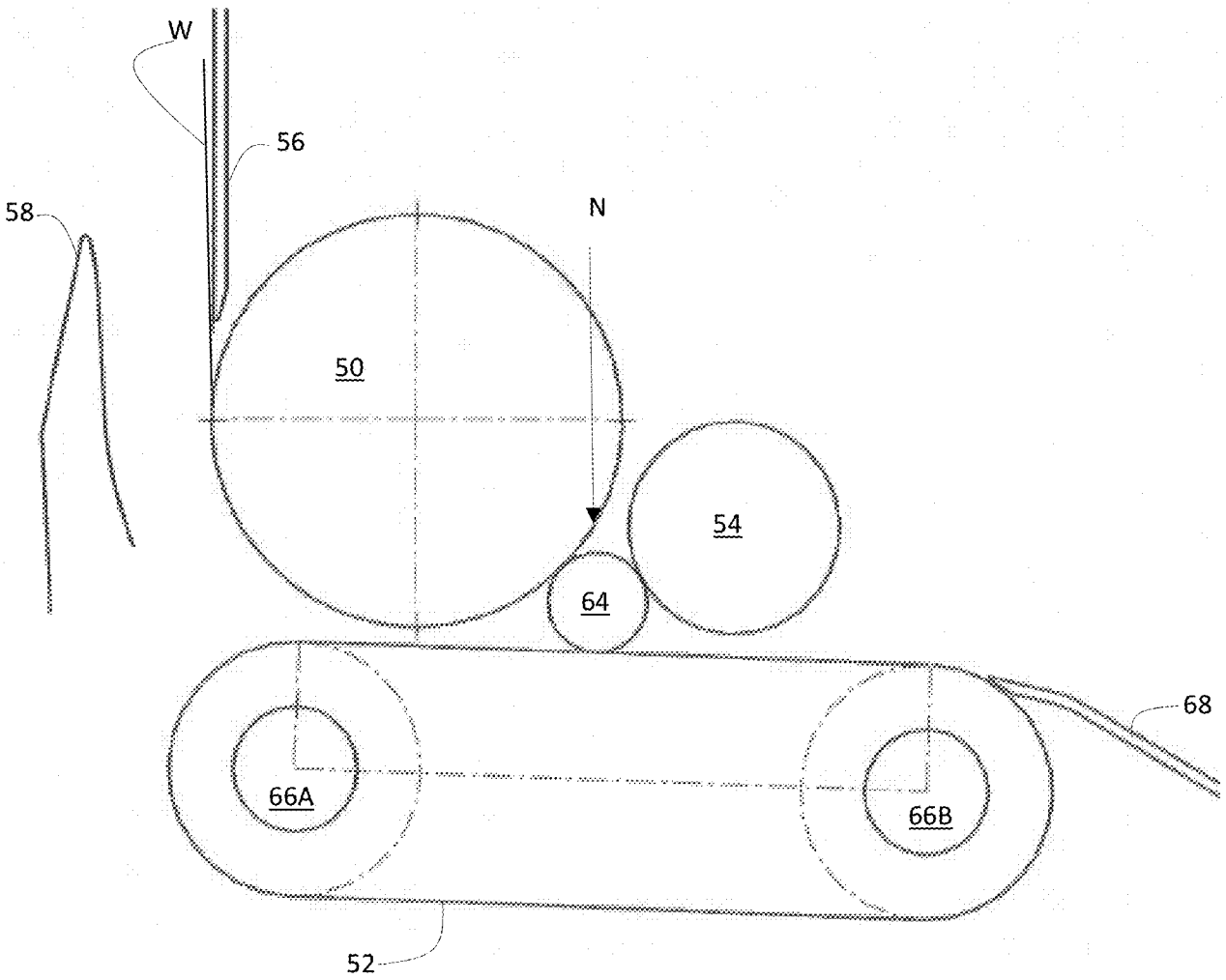
FIG. 8 illustrates the winding nest of FIG. 1, and a rider roll meeting a 40 mm diameter solid log, and the belt moved down to an angle of 2° inclination.
Figure 9:
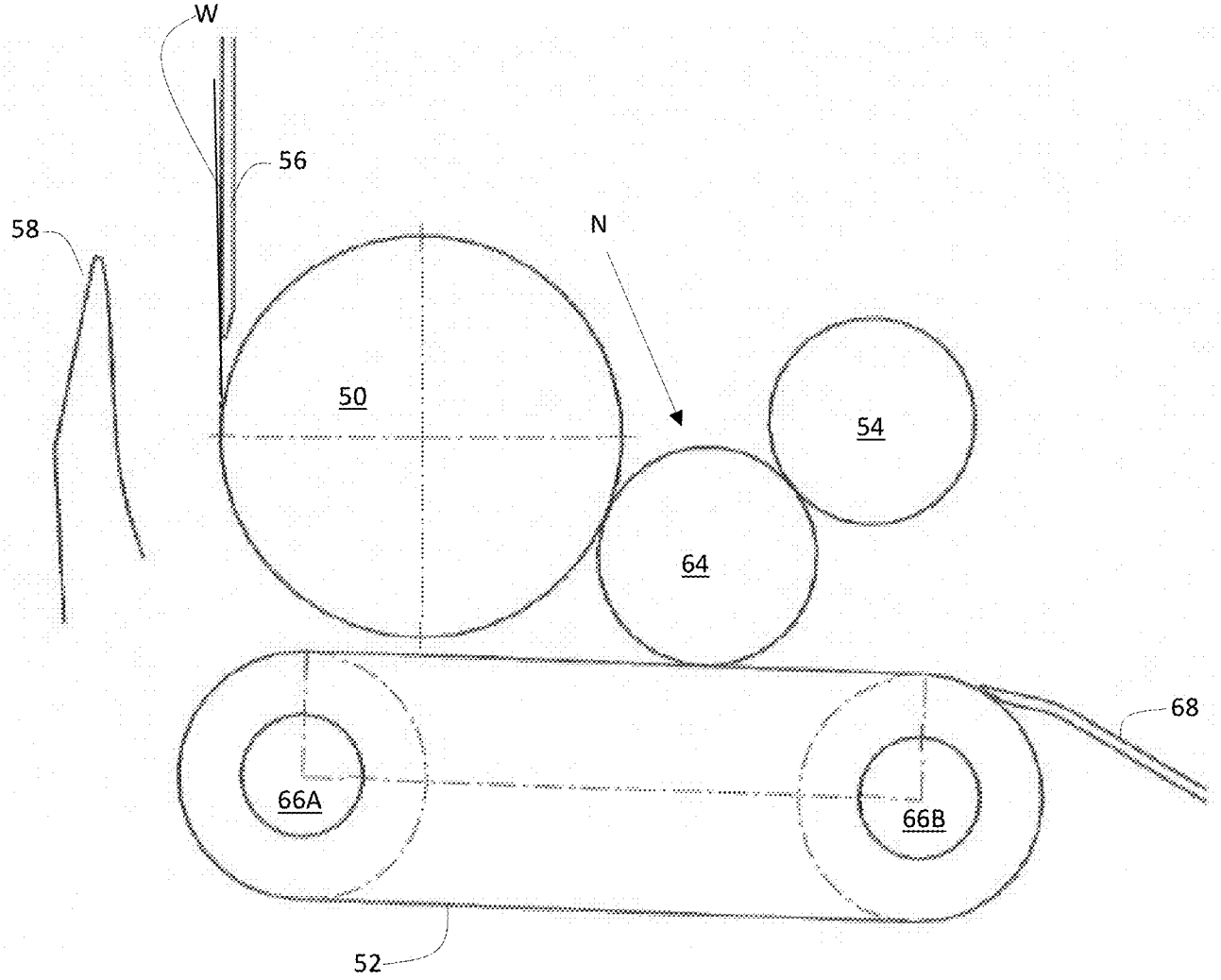
FIG. 9 illustrates the winding nest of FIG. 1, and winding a 90 mm diameter solid log with the belts at an angle of 2° inclination.
Figure 10:
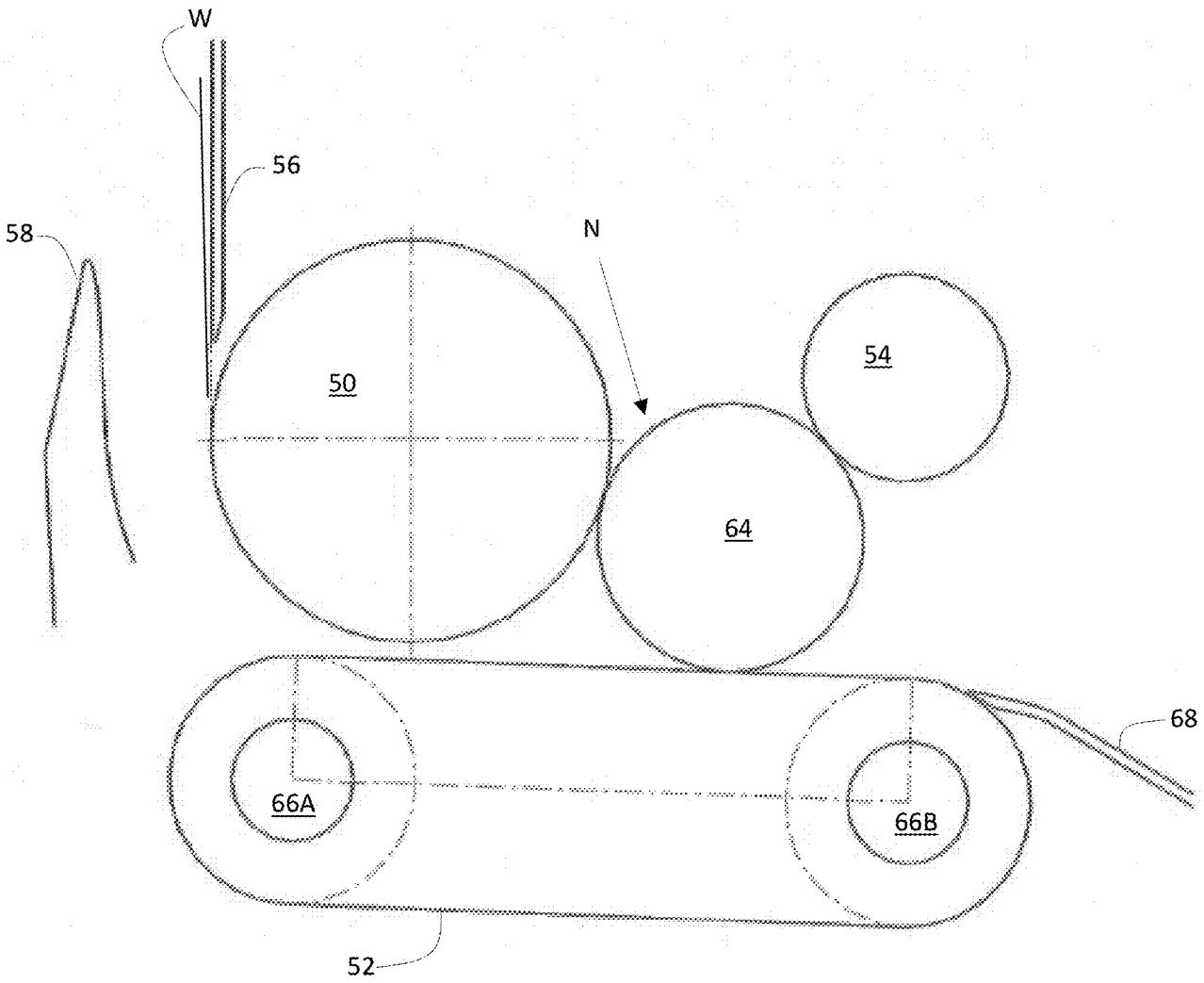
FIG. 10 illustrates the winding nest of FIG. 1, and winding a 110 mm diameter solid log, with the belts at an angle of 2° inclination.
Figure 11:
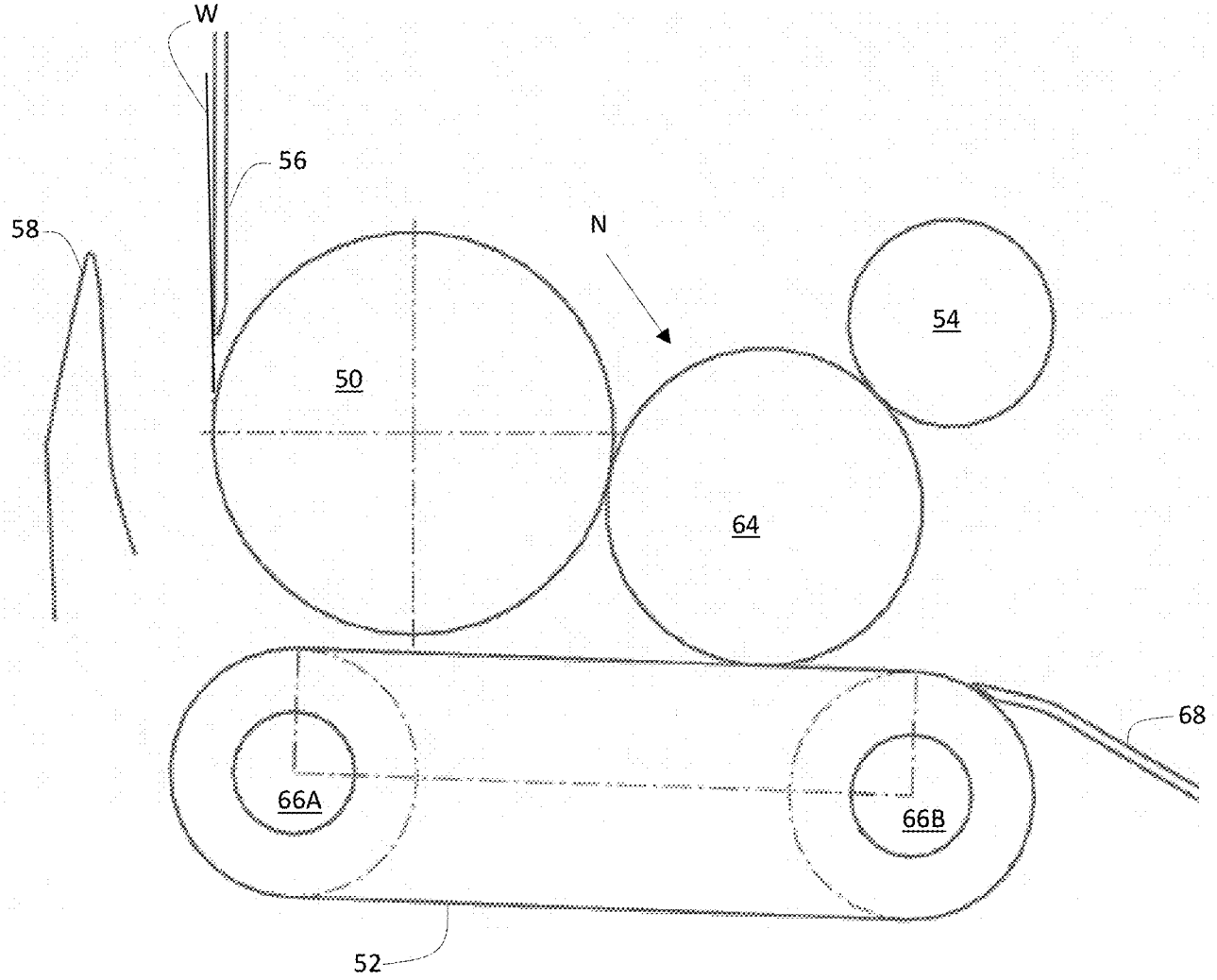
FIG. 11 illustrates the winding nest of FIG. 1, and winding a 130 mm diameter solid log, with the belts at an angle of 2° inclination.
Figure 12:
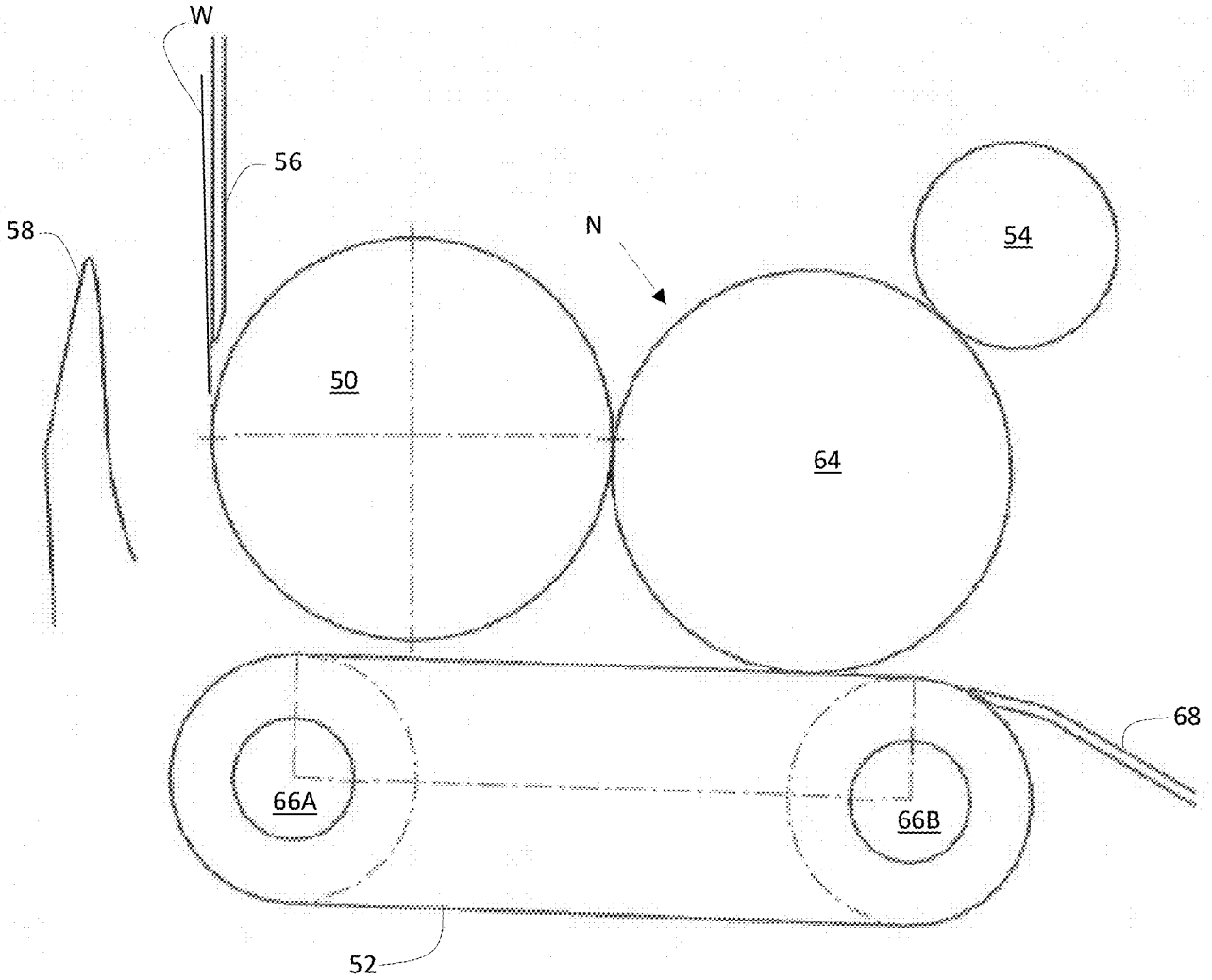
FIG. 12 illustrates the winding nest of FIG. 1, and winding a 165 mm diameter solid log, with the belts at an angle of 2° inclination.
Figure 13:
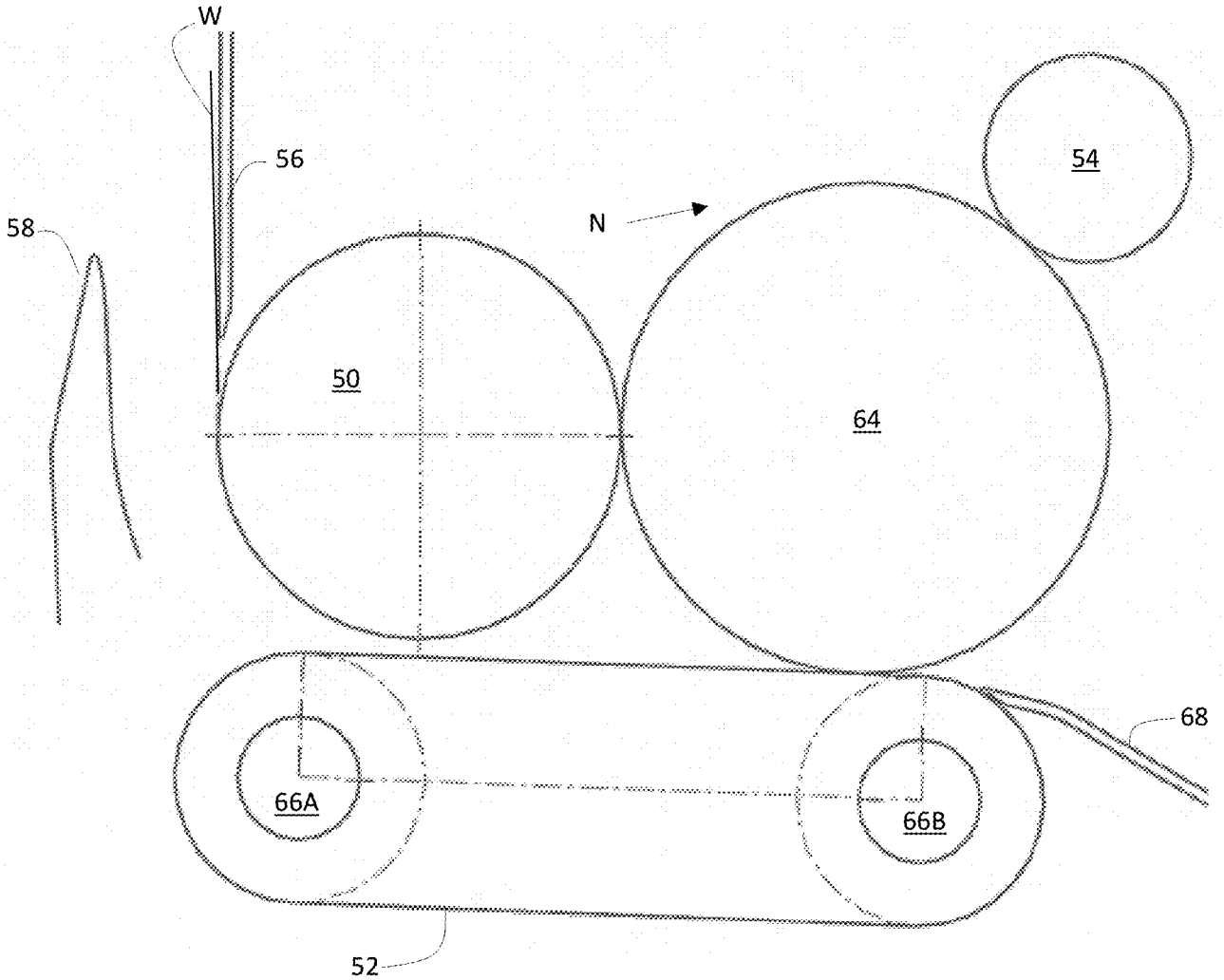
FIG. 13 illustrates the winding nest of FIG. 1, and winding a 200 mm diameter solid log, with the belts at an angle of 2° inclination.

FIGS. 2-10 illustrate the sequence of winding solid logs with the belt and the winding drum. The sequence is repeated for each log, which is termed a cycle. FIG. 2 shows a solid log being wound with a substantial gap between the belt and winding drum. FIG. 3 shows the log near the end of its cycle, so the belt is moved closer to the winding drum and web in preparation to sever the web and initiate the cycle for the next log. FIG. 4 shows the belt contacting the web against the winding drum to sever the web and initiate rolling of the leading end of the web to form a rotating nucleus of web material for the next log. When the belt contacts the web W it slows the web in its localized region of contact. The winding drum, rotating log 64, and rider roll 54 tend to keep moving the web forward downstream of the localized region of belt contact, which induces a tension increase in the web, causing the web to sever at its contact point with the belt, or downstream from its contact point with the belt, preferably on a line of perforations. The web may be severed in its span from the winding drum to the exiting log, or in its region of wrap about the winding drum. Without being limited to any theory, it is believed that after the web is severed, the velocity difference between the belt and the winding drum, and the pressure of the belt on the web against the winding drum, may cause the leading end of the web to roll up on itself, and around itself, and form a rotating nucleus that serves as the basis for the next log. FIG. 5 shows the belt moved partially back down away from the winding drum and the rotating nucleus of wound web material passing through the nip between the winding drum and the belt. FIG. 6 shows the belt moved farther back down away from the winding drum and the rotating nucleus of wound web material emerging from the nip between the winding drum and the belt. FIG. 7 shows the belt moved farther back down away from the winding drum and a small diameter solid log emerging from the nip between the winding drum and the belt. FIG. 8 shows the belt moved back down to its starting position and the rider roll 54 meeting a 40 mm diameter solid log. FIGS. 9-11 show the same system with logs of progressively greater diameter.

Without being limited to any theory, it is believed that when the web is contacted by the belt 52 and winding drum 50, the leading end of the web W very abruptly undergoes a change in direction which causes its leading end to fold over itself and begin rotation, which can cause the formation of a rotating nucleus of web material. As shown in FIG. 4 the web W contacts the belt 52 beyond the point where the belt surface curves around a pulley 66. In this position, the belt may conform to the curvature of the winding drum slightly, causing it to assume a concave shape, which creates a region of contact, not merely a line of contact. This may be helpful in initiation of the formation of the nucleus, due to its added control. The phase of the winding cycle when the nucleus of rotating web material has just formed is critical for control because the log must be advanced toward the winding nest very rapidly as its diameter increases very rapidly. If properly controlled, the rotating nucleus of web material will be advanced toward the winding nest N and remains in contact with both the winding drum and the belt during the transition. Also, it will not inadvertently stall or regress in its translation and become trapped to the left of the nip between the winding drum and belt, and thereby jam and stop the machine. To bring the rotating nucleus of web material and nascent log 64 forward into the winding nest N, the belt 52 has a lower surface speed than the surface speed of the winding drum 50. The speed of the belt 52 may be varied through the product cycle according to a profile such that the nascent log progresses into the winding nest N in a controlled fashion. Preferably the speed profile of the belt 52 is calculated as a function of the delivered web, log diameter, log position, or any combination thereof. The speed profile of the belt is calculated to advance the rotating nucleus of web material and nascent log 64 in a controlled fashion wherein contact of the log is maintained with the winding drum 50 and the belt 52. Belt speed and belt position relative to the winding drum 50 may be changed as necessary based upon the delivered web, log diameter, log position, size of the product, desired firmness of the resultant log, or any combination thereof. The distance between the belt 52 and winding drum 50 may be varied through the product cycle according to a profile that allows the log to progress into the winding nest N in a controlled fashion.

As the winding log 64 continues to advance into the winding nest N and increase in diameter the speed of the belt 52 may continue to be increased. The rotating nucleus of web material and nascent log 64 has its greatest translational advancement velocity immediately after it first forms between the belt 52 and winding drum 50, because the space between the winding drum 50 and the belt 52 diverges only slightly, does not diverge, or even slightly converges at that point. As the winding log 64 advances farther and farther into the winding nest N, the surfaces of the winding drum 50 and the belt 52 diverge ever more greatly, and the log increases in diameter at an ever slower rate due to its increasing circumference. Therefore, the surface speed of the belt 52 is relatively slower at the beginning of each cycle and is increased during the winding cycle to correctly control the log. Then, near the end of the winding cycle, the speed of the belt is slowed to cause the nearly finished log or finished log to discharge from the winding nest N. The slowing of the belt 52 causes the completed log 64 to roll rightward in the drawings, out of the winding nest N, on to a discharge surface 68 for further processing. This rightward travel preferably commences slightly before the web is severed, but it may commence at the same time the web is severed, or after the web is severed. A further purpose of slowing the belt 52 near the end of the winding cycle is to have the belt sufficiently decelerated to the correct velocity for severing the web and for controlling the leading end of the web to cause formation of the rotating nucleus of web material. The start of the deceleration may be timed to cause a correct discharge of the finished or nearly finished log. The magnitude of the deceleration may be chosen to cause a correct web severing and initiation of winding of the web for the next log. The magnitude of the deceleration may be chosen to cause a correct discharge of the finished or nearly finished log and to cause a correct web severing and initiation of winding of the web for the next log.

Figure 14:
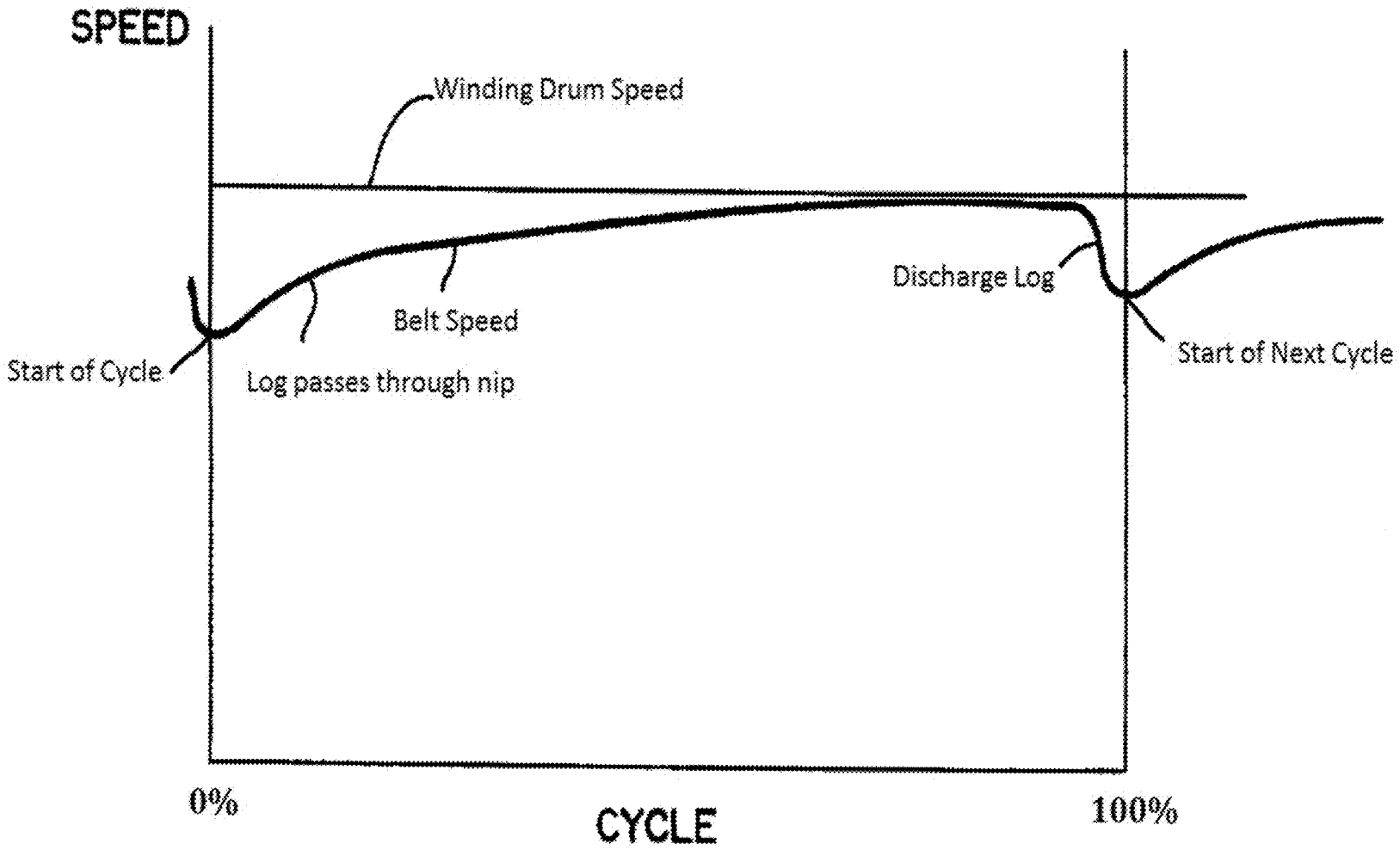
FIG. 14 illustrates an exemplary wind profile.

A control of the rewinder may establish a speed differential between the winding drum and the belt, which in turn controls the web severing, formation of the nucleus of wound web material, and progression of the rotating nucleus of web material and log through the nip between the winding drum and the belt. The surface speed of the belt may be at its lowest speed just before, or at about, the moment the belt contacts the web against the winding drum. The surface speed of the belt may be increased through the winding cycle as the growth of the log diameter and the geometry of the winding nest require a slower forward progression of the log. The surface speed of the belt may be relatively rapidly decreased near the end of the winding cycle, which in turn causes the log to start to advance more rapidly again for discharge. The control may store in memory a speed profile correlating belt speed over time, or belt speed versus wind cycle fraction, for the wind cycle. The belt speed profile may be executed as a position controlled motion. A speed profile may be executed as a position controlled motion by integrating a velocity profile. The belt speed profile may be preset (i.e., calculated and stored in a memory of the control of the rewinder) based on requested product parameters and then may be modified during the wind cycle, or between wind cycles, as needed. The belt speed profile may be preset for at least the intermediate phase of the winding cycle during which a preponderance of the log winding takes place. The belt speed profile may also be preset for any phases of the cycle, such as severing of the web, formation of a rotating nucleus of web material, progression of the rotating nucleus of web material and nascent log through the nip between the winding drum and the belt, introduction of the rotating log into the winding nest, and/or discharge of a log from the winding nest. The belt speed profile may be calculated to account for log progression within the winding nest, increase of the log diameter during the winding, movement of the belt position, or any combination thereof. A calculated speed profile may be used that is based on the physics of the process to promote uniform winding, maximum diameter, and reduced vibration. FIG. 14 is a graph of an exemplary winding belt speed profile.

Without being limited to any theory, it is believed that a winding nest comprising a winding drum and belt, for instance as shown in FIGS. 1-13, forms a winding nest that is favorable for improved control of the progression of the nucleus of rotating web and the nascent log through the nip between the winding drum and belt and into winding nest N. The nucleus of rotating web and the nascent log have their greatest translational velocity during winding at about, or just after, the moment the rotating nucleus is formed. This is because at that moment the diameter of the log, or nucleus, is increasing most rapidly and the space of the nip between the belt and winding drum is diverging most slowly. As discussed above, rotating nucleus and nascent log must be decelerated under good control through the space between the winding drum 50 and the belt 52 to be kept in rotation and kept in contact with the belt and the winding drum to be brought into the winding nest efficiently and reliably. It is believed that if the rotating nucleus and nascent log are decelerated over a greater distance of translation, then the acceleration magnitude may be reduced, which may in turn make the critical phase of the introduction of the rotating nucleus and nascent log into the winding nest better able to accommodate variations in the properties of the incoming web material, and machine operating conditions. It is believed that reduced acceleration magnitude may be less disruptive to the windings in the log and may better preserve the thickness of the web. Generally speaking, the surfaces of two opposing drums diverge more rapidly as an object passes through the space between them compared to the surfaces of a drum and an opposing belt if the belt surface is substantially a flat plane. Therefore, a winding nest with a winding drum and a belt may be configured to have a greater translational distance sufficient for decelerating the rotating nucleus and nascent log during introduction into the winding nest N.

A rider roll 54 may be positioned in the winding nest N with a positioning mechanism 70 (FIG. 1). The positioning mechanism 70 may allow for compound motion, arcuate motion, linear reciprocating motion or any combination thereof through positioning motors and linkages. The positioning mechanism for the rider roll 54 preferably allows for compound motion so that the rider roll may maintain preferred log containment positions in the winding nest N during the preponderance of the log winding cycle. FIGS. 6-8 show a rider roll 54 meeting an incoming log. FIGS. 9-13 show the rider roll 54 on the log during winding, at a position substantially equidistant from the winding drum 50 and belt 52. FIGS. 4-5 show the rider roll 54 at a higher position on the log 64. The rider roll may be moved to a higher position to increase the space between the rider roll 54 and the belt 52 to allow a sufficient gap through which the discharging log can pass. Near the end of the winding cycle, the rider roll positioning mechanism may move the rider roll 54 upward and nearer the top of the winding log 64 to afford an adequately large gap between the rider roll 54 and the belt 52 for the log to pass through to the discharge surface 68. The rider roll may have its surface speed increase during its upward movement around the log so its movement does not scuff or damage or wrinkle the log web wraps. The rider roll may have its surface speed increase at or near the end of the wind cycle to assist with accelerating the log for discharge. The rider roll may have its surface speed increase at or near the end of the wind cycle to elevate the tension in the upstream web, or maintain the tension in the upstream web, which may be beneficial for the belt to sever the web when it contacts the web at the winding drum at the end of the cycle. After the finished log 64 has moved clear of the rider roll 54 and the return path of the rider roll to the winding nest N, the rider roll may move down quickly to meet the next incoming log. The winding drum 50, belt 52, and rider roll 54 provide three regions of contact at the log periphery for driving and controlling the winding log during the winding cycle. The rider roll speed profile and rider roll position motion profile may be calculated to account for log progression within the winding nest, increase of the log diameter during the winding, movement of the belt position, or any combination thereof.

A discharge surface 68 may be provided downstream from the end of the belt 52. The discharge surface 68 may include a table that has a starting position just beyond the point where the belt starts to curve around the rotatable pulley 66B. If multiple parallel belts are used, the table may include fingers that interdigitate with the spacings between parallel belts. The fingers may extend beyond the curved portions of the belts, so that the log 64 transitions more gradually from the surfaces of the belts to the fingers of the discharge table. The discharge table fingers may have coordinated motion with the belt positioning mechanism, so a constant relationship is maintained between the fingers and belts. The discharge table fingers may be positionable independent of the belts, for instance, to recede beneath the belts at a position farther upstream in the winding nest for smaller diameter products and farther downstream in the winding nest for larger diameter products. The fingers may be positioned in order to set a desired distance over which the logs roll on the belts as they discharge. A discharge gate 136, or other device known in the art, may be provided downstream of the winding nest to capture a finished wound log, and/or control the timing of the exit of the finished wound log from the rewinder.

The belt 52 may be of unitary construction, or consist of at least two portions: (i) a log contact side that engages the log, and (ii) a pulley contact side that engages a pulley that drives the belt. The log contact side of the belt may have a covering layer. The log contact side of the belt is preferably wear resistant and has a high traction and/or high grip characteristic. The log contact side of the belt may comprise a rubber or elastomer type of material with high grip characteristics. The log contact side of the belt may comprise a rough surface with high traction characteristics. The log contact side of the belt may be changed or modified to have more or less grip or traction. A covering layer of the belt may be softer or harder, thicker or thinner, more or less compliant, depending upon the application, to provide desired characteristics for the interaction of the belt and the winding log, and for interaction of the belt and the web and the winding drum to facilitate web severing and formation of the rotating nucleus of web material. Surface textures may be imposed or deployed on the log contact side of the belt by casting, imprinting, machining, laser engraving, implanting, etc. Protrusions or embossments may be utilized on the log contact side of the belt. A high traction and/or grip characteristic on the log contact side of the belt is preferable to afford control of the winding log at its nip with the belt in the introduction, winding, and discharge phases even with minimal or minimized or low contact pressure at the nip. The pulley contact side of the belt may have a high traction and/or high grip characteristic, to reduce or minimize or eliminate slipping of the belt on the drive pulley during its acceleration and deceleration phases of the cycle. The pulley contact side of the belt may have an array of teeth which engage grooves in the pulleys to reduce or minimize or eliminate slipping of the belt on the pulley during its acceleration and deceleration phases of the cycle. The belt may have internal cords, as is known in the art, to increase its resistance to changing in length, so it remains substantially at a constant length during operation, including during its acceleration and deceleration phases of the winding cycle.

The tension in the belt 52 may be adjusted higher or lower depending upon the application to provide desired winding dynamics and interaction of the belt and the winding log, and desired interaction of the belt and the web and the winding drum to facilitate web severing and formation of the rotating nucleus of web material. In one embodiment, tension in the belt 52 may be modified during the winding cycle as part of a winding profile, or based on sensors or other feedback measurements, in order to increase or reduce nip pressure, increase or reduce web elongation, or alter other system characteristics, to facilitate web severing and formation of the rotating nucleus of web material. The tension may be changed in the belt 52 by moving one of the two pulleys 66 shown relative to the other, or by using a movable third pulley or movable sliding shoe (not shown) that acts against a span of the belt (e.g., the lower span) to alter the tension in the belt.

As mentioned earlier, rather than a single belt, a plurality of parallel spaced apart belts may be provided. For instance, each belt in the plurality of belts may be about 100 mm wide or up to about 500 mm wide or wider with a spacing or gap of about 25 mm between the belts. Each of the belts in the plurality of belts may be independently adjustable to accommodate any variation between the belts. A tensioner, movable third pulley, or sliding shoe may be used in connection with each belt to provide an adjustment to ensure proper tension. The plurality of belts may be driven with one pulley or each belt may have a dedicated pulley.

While the configuration of the winding nest of FIGS. 1-13 shows one rider roll 54, the machine may include two rider rolls instead of one. The rider rolls may use the same positioning mechanism, and such a positioning mechanism may provide compound motion, arcuate motion, linear reciprocating motion or any combination thereof. In the alternative, a separate positioning mechanism for each rider roll may be provided. In connection therewith, in one example, one rider roll may have simple arcuate motion centered about the center of the winding drum with its positioning system, and the second rider roll may have compound motion with its own dedicated positioning mechanism. The rider roll closer to the winding drum may engage the incoming log first. As the log increases in diameter during the winding cycle, the first rider roll may travel toward the top of the winding log, making space for the second rider roll to engage the log at the side of the log. For very small diameter logs, the system may be configured to use only one of the rider rolls, where there may not be space available to have both rider rolls engaged during a majority of the winding cycle. The rider roll closer to the winding drum only may be used. Alternatively, the rider roll closer to the winding drum may be parked out of the way and the second rider roll only may be used.

Another alternate embodiment is a winding nest comprising a winding drum 50 and a belt 52 as shown and described in connection with FIGS. 1-13, but with the rider roll 54 omitted. In connection with this embodiment the rotating nucleus of web material and nascent log would pass into the winding area N as with the other embodiments, with its introduction controlled by the winding drum 50 and speed profile of the belt 52. The speed profile of the belt comprises a cyclic reduction and increase of the speed, as described previously. The belt 52 would also have its position varied with respect to the winding drum to further control the log progression, as described previously. In various cases, for example winding relatively firm logs, or at reduced winding speeds, or of narrower web widths, or a combination thereof, control of the log by the winding drum 50 and belt 52 may be sufficient for the entire winding cycle without the assistance of a rider roll 54. The belt speed may be increased, or elevated, which tends to wind the log tighter, and also tends to increase the contact pressure of the log against the winding drum, which affords further control of the log. When the winding of the log is nearly complete the belt 52 may decrease in speed, causing the log to move away from the winding drum 50 for discharge, as previously described. The surface of the belt may have a slight incline downward toward the log discharge direction, which may assist with log discharge. An advantage of this embodiment is the reduced cost of having no rider roll(s). As was described above, it may be effective and economical at winding relatively firm logs, or at reduced winding speeds, or of narrower web widths. It may be useful especially in winding products which are often converted in narrower web widths. This may include plastic films, nonwovens, pressure sensitive substrates, specialty web materials, and the like.

A log end engaging assembly, or two log end engaging assemblies, may be provided in a machine configured for winding solid logs and, depending on the application, rotationally drive the logs during the winding cycle, similar to the core end engagement assemblies described in co-owned and co-pending PCT application serial no. PCT/US2018/062462, and U.S. application Ser. No. 16/201,034. Instead of chucks which engage cores, other devices would be employed which may engage the web windings of the solid logs, or the end faces of the solid logs, or both. A log end engagement assembly may be provided at one end of the log. A second log end engagement assembly may be provided axially opposite the log of the first log engagement assembly. The log engagement assemblies may be rotationally driven by a motor or motors. Their rotational speed profile may substantially match the rotational speed that theory suggests the winding log should have for the case of zero interlayer slip. The engagement assemblies may be caused to rotate faster for at least part of the cycle, causing the log to wind tighter. The engagement assemblies may be caused to rotate slower for at least part of the cycle, causing the log to wind looser.

The belt 52 may be supported by upstream and downstream pulleys 66A, 66B. The belt 52 may be driven to have a surface velocity by the downstream pulley and a motor 125 coupled thereto. A pulley 66C may be provided in the portion of the belt loop opposite the log contact portion of the loop. The pulley 66C may be movable to facilitate setting the tension in the belt. The pulley 66C may be moveable to facilitate mounting and/or dismounting a belt 52. If a third pulley 66C is not provided, then pulley 66A may be movable to facilitate setting the tension in the belt and/or to facilitate mounting and/or dismounting a belt 52. The belt 52 may have a support 126 inside the belt loop that may operate against its inside surface in the portion of the belt loop that contacts the log 64. This support surface 126 is preferably flat. The support surface may also be slightly concave or convex. The support surface 126 may be in continuous contact with the belt during operation or intermittent contact, or not in contact. The belt support surface 126 tends to prevent excessive deflection or deformation of the belt. The support surface 126 may be set to have a gap to the belt 52 when idle. The belt 52 may contact the support surface 126 when it deflects or deforms under the load of a heavy winding log, or rider roll nip pressure transmitted through the log, or a crash event, or during an instance of a web blowout or failed log discharge, or the like. The belt 52 may contact the support surface 126 when it deflects or deforms under the load of pressing the web against the winding drum to sever the web, or when it applies pressure to initiate winding of the web into a rotating nucleus, or due to pressure of the winding drum nip transmitted through a rotating nucleus of web material or a nascent log. The support surface 126 is preferably comprised of low friction material, or coated with a low friction material, to minimize power losses to friction and/or wear of the belt and/or wear of the support surface. Exemplary low friction materials are plastics, acetal, nylon, and the like. The upstream and downstream ends of the support surface 126 may have chamfers and/or radii along their edges to facilitate smooth transfer of the belt or belt teeth onto and off of the support surface. Also, there may be a structure 128 to support the pulleys 66A, 66C rotatably mounted in bearings, and the belt support surface 126. The support 128 may comprise a beam element that extends substantially for the width of the belt(s) 52. The structure 128 may be supported from a beam outside the loop at or near its ends and optionally at intermediate points, or an intermediate point, as well. Utilizing an intermediate support or intermediate supports may allow the structure 128 to be sized smaller and with less mass, which is favorable for rapid motions.

Cyclically moving the belt surface 52 farther from and closer to the winding drum 50 as described above may be accomplished by a belt positioning apparatus 130, which may comprise pivots, linkages, or a slide, or a combination thereof. Preferably, the belt positioning apparatus 130 includes pivoting motion driven by a motor 132 and linkages. Preferably, the belt 52 may be pivoted about the downstream pulley 66B, which may also be the drive pulley for the belt 52. The downstream pulley 66B may be comprised of a single pulley. The downstream pulley may be comprised of at least two adjacent coaxial pulleys, with at least one intermediate bearing support between them. Also arranged on the beam 134 may be a pivot with a crank arm 138 to control a four-bar linkage which is connected near the upstream end of the belt 52, which may be used to raise and lower the upstream end of the belt. The coupler of this four-bar linkage may connect at the axis of the upstream pulley 66A. A crank arm and 4-bar linkage may be disposed at each end of the belt system to control its position. A crank arm and 4-bar linkage may be disposed at at least one intermediate point of the belt system to control its position. The crank arms on the pivot are controlled by a motor with position feedback to execute the motion profile of the belt position for the severing the web, initiating winding through creation of a rotating nucleus of web material, advancing the rotating nucleus and nascent log into the winding nest, and winding of the log. The belt positioning mechanism 130 may also be used to optimize the size of the space of the nip between the belt 52 and the winding drum 50 during log winding, and/or the angle of the belt. A beam 134 may be movable with respect to the winding drum 50 to adjust and optimize the space between the belt 52 and the winding drum 50. The space may be adjusted based on the web thickness and the requirements needed to sever the web and initiate winding of the web, and is independent of the belt inclination angle. This movement may be used to adjust the height of the belt system to compensate for reduction in thickness of the belt from wear. The movement may be accomplished by supporting the beam 134 on linear slides (not shown). The discharge surface 68 may be supported from the same beam 134, to facilitate retaining a correct relationship between the discharge surface 68 and the belt 52 when the belt height is adjusted. It is preferable that the exit height of the log from the rewinder is constant, so a fixed height rolling surface (not shown) may be provided downstream from the adjustable height discharge surface, with fingers on its upstream side interdigitate with fingers on the downstream side of the discharge surface 68 to ensure a reliable log transition. A discharge gate may be provided above the discharge surface 68 to capture finished wound logs and/or control the timing of the exit of the finished wound logs from the rewinder apparatus.

FIG. 1 illustrates a positioning system 70 which may be used for the rider roll 54. The positioning system 70 allows for compound motion, which is a 2 degree-of-freedom device capable of arc motion, linear motion, or any combination thereof. This is accomplished by having motor controlled crank arms at the lower left pivot and motor controlled crank arms at the upper right pivot. Together the motors control the position of the rider roll 54 and can move it through the winding nest according to any motion path. The crank arms at both pivots are controlled by motors with position feedback to execute the motion profile of the rider roll position. The motors used to control the rider roll position may be mounted with their axes of rotation coincident to the lower left pivot and upper right pivot. The rotational drive for the rider roll 54 may comprise timing belts operating on pulleys which are mounted adjacent to and coaxial with the linkage joints. The timing belt drive may extend in sequence back to a motor with its axis of rotation mounted coincident to the lower left pivot, or near the lower left pivot.

This apparatus and method for producing solid logs are advantageous because the same equipment, with relatively minor modifications and adjustments, can be used also to produce typical logs with tubular cores inside, or coreless logs by winding the web on mandrels which are subsequently removed from the logs. It is further advantageous, relative to cost and complexity of the machine, that a single device, the belt, may be used for severing the web, initiating winding of the web into a rotating nucleus and nascent log, controlling its introduction into the winding nest, completing the winding of the log, and controlling its discharge.

It is believed that using a belt with tangential surface velocity to perform the web cutoff and the initiation of winding may be superior to an alternative method of snubbing the web with a device that only oscillates, and does not have tangential surface velocity. A belt that has tangential surface velocity may be superior because it can also be used to wind the reminder of the log, which may afford a system with less complexity made of fewer components. Also, because the belt has tangential surface velocity in the opposite direction as the winding drum, rather than zero velocity, it may be more efficient at severing the web and initiating winding of the web. And, because the belt has this tangential surface velocity, rather than zero velocity, the magnitude of its velocity relative to the web and the winding drum may be adjusted to optimize the process.

It is believed that using a belt with tangential surface velocity and a rotating winding drum to perform the web cutoff and the initiation of winding may be superior to an alternative method of using a pair of opposed rotating drums. The belt may be superior to a rotating drum because it affords an extended length nip for the formation of the nucleus, and because it may be construed to be slightly concave about the upper roll, to further extend the length of the nip. A belt acting with a rotating drum should be more robust in operation, due to the elongated nip, because there is less chance of the log stalling and being trapped at the back (upstream) side of the nip, or of moving too fast out the front (downstream) side of the nip—with accompanying loss of control—if the substrate varies or the machine settings are imperfect. This relates to the rate at which the surfaces converge at the upstream side of the nip and diverge at the downstream side of the nip. Because the nip of a belt with a winding drum can be configured to converge and diverge more slowly, the nip is effectively elongated and is more forgiving in forming and controlling the rotating nucleus of web, whereas when two drums are used, the nucleus has to be precisely "balanced" on the lower drum to not lag too far back and stall, nor advance too far forward and slip out of the nip. It also relates to the arrangement of having the belt located under its nip with the winding drum and under the winding log, and that the belt is nearly or substantially horizontal, such as inclined from horizontal by less than 15° (more preferably by less than 11°, and more preferably by less than 7°). If the nucleus is slightly farther back in the nip than optimal, perhaps upstream of the smallest transverse dimension of the nip, it may still move forward, into and through the nip, due to its required path of motion being substantially horizontal, or slightly downhill, whereas in the case of two opposing drums the nucleus may have to move upward and around the lower drum to move into and through the nip. If the nucleus is slightly farther ahead in the nip than desired, it may still be controlled by the substantially horizontal, or slightly inclined, belt to remain in contact with the winding drum and progress smoothly into the winding nest, whereas in the case of two opposing drums the nucleus may be more prone to move prematurely down the surface of the lower drum, lose contact with the upper winding drum, stop winding web, and jam the machine.

The substantially flat, even possibly slightly concave, shape of the belt at its nip with the nascent log, rotating nucleus, or upper roll when contacting the web to sever it, may be enhanced by varying the characteristics or adjustments of the belts. The material on the surface of the belt may be compliant, and thus conform under pressure from the nascent log, rotating nucleus, or contact with the web against the upper roll. The belt itself may be stretchable or elastic, and may extend under forces caused by pressure from contact with the nascent log, rotating nucleus, or contact with the web against the upper roll. The tension setting in the belt may also be varied to influence the contact pressure and thus its deformation and/or deflection.

A discussed above, several aspects of forming the roll are provided. In one aspect of the method, a winding drum is rotated about a center axis of the winding drum and a web material is directed around the winding drum. A continuous loop is positioned in a spaced apart relationship relative to the winding drum to form a nip between a surface of the continuous loop facing the winding drum and the winding drum and to define a winding space between the continuous loop and the winding drum. The web material is directed through the nip between the surface of the continuous loop facing the winding drum and the winding drum. The continuous loop and the winding drum are operated in a manner to wind the web material about a lead edge of the web material in the winding space and form a log of wound web material, and to sever the web material to form a successive log of wound web material.

Another aspect of the method comprises moving the continuous loop relative to the winding drum to change a spacing of the nip.

Another aspect of the method comprises positioning a rider roll relative to the continuous loop and the winding drum to define a winding space with the winding drum and the continuous loop.

Another aspect of the method comprises moving the rider roll relative to the continuous loop and the winding drum to allow for an increase in the diameter of the log in the winding space during winding of the web material about the lead edge of the web material.

Another aspect of the method comprises moving the rider roll with one of compound motion, arcuate motion, and linear reciprocating motion.

Another aspect of the method comprises moving a further rider roll relative to the continuous loop, the rider roll, and the winding drum to allow for an increase in the diameter of the log in the winding space during winding of the web material about the lead edge of the web material.

Another aspect of the method comprises moving the rider roll with arcuate motion and moving the further rider roll with compound motion.

Another aspect of the method comprises supporting the log in the winding space by the continuous loop.

Another aspect of the method comprises changing a speed of the continuous loop relative to the speed of the winding drum in a manner to enable a center of the winding log to translate away from the winding drum along the continuous loop.

Another aspect of the method comprises operating the continuous loop and the winding drum in a manner to wind the web material about the lead edge of the web material in the winding space and form the log, and changing a speed of the continuous loop relative to the speed of the winding drum during winding of the web material about the lead edge of the web material.

Another aspect of the method comprises operating the continuous loop and the winding drum in a manner to wind the web material about the lead edge of the web material in the winding space and form the log, and reducing a speed of the continuous loop relative to the speed of the winding drum to advance the log from the winding nest.

Another aspect of the method comprises operating the continuous loop and the winding drum in a manner to wind the web material about the lead edge of the web material in the winding space and form the log, and operating the continuous loop to sever the web material as the log advances from the winding nest.

Another aspect of the method comprises operating the continuous loop to sever the web material, and positioning the continuous loop relative to the winding drum to decrease a spacing of the nip.

Another aspect of the method comprises initiating winding of the web material into a successive log about a successive leading edge of the web material after severing the web material.

The embodiments were chosen and described in order to best explain the principles of the disclosure and their practical application to thereby enable others skilled in the art to best utilize said principles in various embodiments and with various modifications as are suited to the particular use contemplated. As various other modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A rewinding machine for winding web material into a log, the machine comprising:

a winding drum rotatable about a center axis and about which the web material to be wound is directed; and a continuous loop spaced from the winding drum and with the winding drum defining a nip through which the web material is directed when winding the web material into the log, the continuous loop being configured to move in a direction generally opposite of a direction of the winding drum at the nip, the continuous loop being configured to change speed relative to a speed of the winding drum during winding the web material into the log about a lead edge of the web material, the continuous loop being positionable relative to the winding drum at the nip to accommodate winding the web material into the log about the lead edge of the web material and to sever the web material.

2. The rewinding machine of claim 1 further comprising a rider roll defining a winding space with the winding drum and the continuous loop, the rider roll being movable relative to the continuous loop and the winding drum to allow an increase in a diameter of the log in the winding space during winding of the web material into the log about the lead edge of the web material.

3. The rewinding machine of claim 2 wherein the rider roll is positioned relative to the continuous loop and the winding drum with a positioning mechanism providing at least one of compound motion, arcuate motion, and linear reciprocating motion.

4. The rewinding machine of claim 3 further comprising a further rider roll being movable relative to the continuous loop, the rider roll, and the winding drum to allow an increase in a diameter of the log in the winding space during winding of the web material into the log about the lead edge of the web material.

5. The rewinding machine of claim 1 wherein the continuous loop has a span facing the winding drum defining a surface on which the log travels in the winding space.

6. The rewinding machine of claim 5 wherein the continuous loop is adapted and configured to be positioned relative to the winding drum to sever the web material as the log advances on the continuous loop.

7. The rewinding machine of claim 6 wherein the continuous loop is adapted and configured to reduce speed relative to the speed of the winding drum to discharge the log from the continuous loop.

8. The rewinding machine of claim 6 wherein the continuous loop is adapted and configured to reduce speed relative to the speed of the winding drum to initiate winding of the web material into a successive log about a successive leading edge of the web material after severing the web material.

9. The rewinding machine of claim 1 wherein the continuous loop is adapted and configured to reduce speed relative to the speed of the winding drum to advance the log from the winding nest.

10. A rewinding machine for winding web material into a log about the lead edge of the web material, the machine comprising:

a winding drum rotatable about a center axis and about which the web material to be wound is directed; and a continuous loop spaced from the winding drum and with the winding drum defining a nip through which the lead edge of the web material is inserted and through which web material is directed when winding the web material into the log about the lead edge of the web material, the continuous loop being adapted and configured to move in a direction generally opposite a direction of the winding drum at the nip, the continuous loop being adapted and configured to change speed relative to a speed of the winding drum during winding of the web material about the lead edge of the web material, the continuous loop being movable relative to the winding drum to change a spacing of the nip.

11. The rewinding machine of claim 10 wherein the continuous loop has a span facing the winding drum defining a surface on which the log travels in the winding space.

12. The rewinding machine of claim 10 wherein the continuous loop is adapted and configured to reduce speed relative to the speed of the winding drum to advance the lead edge of the web material through the nip between the winding drum and the continuous loop.

13. The rewinding machine of claim 10 wherein the continuous loop is adapted and configured to reduce speed relative to the speed of the winding drum to advance the log from the winding nest.

14. The rewinding machine of claim 13 wherein the continuous loop is adapted and configured to be positioned relative to the winding drum to sever the web material as the log advances on the continuous loop.

15. The rewinding machine of claim 13 wherein the continuous loop is adapted and configured to reduce speed relative to the speed of the winding drum to initiate winding of the web material into a successive log about a successive leading edge of the web material after severing the web material.

16. A method comprising:

rotating a winding drum about a center axis of the winding drum and directing a web material around the winding drum;

positioning a continuous loop in a spaced apart relationship relative to the winding drum to form a nip between a surface of the continuous loop facing the winding drum and the winding drum and to define a winding space between the continuous loop and the winding drum;

directing the web material through the nip between the surface of the continuous loop facing the winding drum and the winding drum; and operating the continuous loop and the winding drum in a manner to wind the web material about a lead edge of the web material in the winding space and form a log of wound web material, and to sever the web material to form a successive log of wound web material.

17. The method of claim 16 further comprising moving the continuous loop relative to the winding drum to change a spacing of the nip.

18. The method of claim 16 further comprising positioning a rider roll relative to the continuous loop and the winding drum to define a winding space with the winding drum and the continuous loop.

19. The method of claim 18 further comprising moving the rider roll relative to the continuous loop and the winding drum to allow for an increase in the diameter of the log in the winding space during winding of the web material about the lead edge of the web material.

* * * * *